US011459064B1

(12) United States Patent
Simard et al.

(10) Patent No.: US 11,459,064 B1
(45) Date of Patent: Oct. 4, 2022

(54) HULL OF A WATERCRAFT

(71) Applicant: BOMBARDIER RECREATIONAL PRODUCTS INC., Valcourt (CA)

(72) Inventors: Richard Simard, Drummondville (CA); Simon Erpelding, Racine (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 62 days.

(21) Appl. No.: 17/039,625

(22) Filed: Sep. 30, 2020

Related U.S. Application Data

(60) Provisional application No. 62/929,004, filed on Oct. 31, 2019, provisional application No. 62/908,514, filed on Sep. 30, 2019.

(51) Int. Cl.

| | |
|---|---|
| ***B63B 3/68*** | (2006.01) |
| ***B63H 11/00*** | (2006.01) |
| ***B63B 1/12*** | (2006.01) |
| ***B63B 59/02*** | (2006.01) |
| ***B63H 21/12*** | (2006.01) |
| ***B63B 3/48*** | (2006.01) |

(52) U.S. Cl.
CPC ..... *B63B 3/68* (2013.01); *B63B 1/125* (2013.01); *B63B 3/48* (2013.01); *B63B 59/02* (2013.01); *B63H 11/00* (2013.01); *B63H 21/12* (2013.01)

(58) Field of Classification Search
CPC .... B63B 3/00; B63B 3/02; B63B 3/14; B63B 3/16; B63B 3/48; B63B 3/68; B63B 1/10; B63B 1/12; B63B 1/125; B63B 1/126; B63B 59/02; B63H 11/00; B63H 21/12
USPC ..... 114/61.1, 61.2, 61.27, 61.29, 61.31
See application file for complete search history.

(56) References Cited

U.S. PATENT DOCUMENTS

| | | | | |
|---|---|---|---|---|
| 2,585,599 | A | 2/1952 | Tehetchet | |
| 2,991,746 | A | 7/1961 | Cunningham | |
| 3,316,873 | A | 5/1967 | Dismukes | |
| 3,601,077 | A | 8/1971 | Valenza | |
| 3,661,108 | A | 5/1972 | Sorenson | |
| 3,833,284 | A | 9/1974 | Kaminow et al. | |
| 3,970,025 | A | 7/1976 | Sovia et al. | |
| 3,996,868 | A * | 12/1976 | Schagen | B63B 32/53 441/74 |
| 4,924,797 | A | 5/1990 | Solia | |
| 5,619,944 | A | 4/1997 | Baker | |
| 5,676,087 | A | 10/1997 | Baker | |
| 5,803,007 | A | 9/1998 | Stevens | |
| 6,199,340 | B1 | 3/2001 | Davis | |

(Continued)

*Primary Examiner* — Daniel V Venne
(74) *Attorney, Agent, or Firm* — BCF LLP

(57) ABSTRACT

A method of assembling a watercraft of a family of watercraft includes, when assembling a first watercraft, attaching a front hull panel to a rear hull panel such that the front hull panel extends forwardly of the rear hull panel. The front hull panel and the rear hull panel form a hull of the first watercraft. The method also includes, when assembling the second watercraft: attaching a hull extension panel to the rear hull panel such that the hull extension panel extends forwardly of the rear hull panel; and attaching the front hull panel to the hull extension panel such that the front hull panel extends forwardly of the hull extension panel. The front hull panel, the hull extension panel and the rear hull panel form a hull of the second watercraft. The second watercraft has a second hull length greater than a first hull length of the first watercraft.

19 Claims, 24 Drawing Sheets

(56) References Cited

U.S. PATENT DOCUMENTS

| | | | | |
|---|---|---|---|---|
| 6,345,581 | B2 | 2/2002 | Blanchard | |
| 6,546,890 | B1 | 4/2003 | Craig | |
| 6,988,456 | B1 | 1/2006 | Schooler | |
| 7,143,710 | B2 | 12/2006 | Lang et al. | |
| 7,185,599 | B1 | 3/2007 | Griffiths et al. | |
| 7,188,576 | B2 | 3/2007 | Bogard et al. | |
| 7,418,915 | B2 | 9/2008 | Campbell | |
| 7,533,622 | B1 | 5/2009 | Jaszewski et al. | |
| 8,186,291 | B1 | 5/2012 | Curtis | |
| 8,272,907 | B2 * | 9/2012 | Lindstrom | B63B 32/53 441/74 |
| 9,038,561 | B2 | 5/2015 | Loui et al. | |
| 9,108,710 | B1 | 8/2015 | Broughton et al. | |
| 9,114,853 | B1 | 8/2015 | Apple et al. | |
| 9,475,548 | B1 | 10/2016 | Slocum | |
| 9,517,824 | B1 | 12/2016 | Erpelding et al. | |
| 2003/0154896 | A1 | 8/2003 | Schmidt | |
| 2004/0168623 | A1 | 9/2004 | Kirk | |
| 2005/0126464 | A1 | 6/2005 | Lang et al. | |
| 2007/0039534 | A1 | 2/2007 | Reilly et al. | |
| 2007/0039535 | A1 | 2/2007 | Reilly et al. | |
| 2007/0056496 | A1 | 3/2007 | Hodgson | |
| 2009/0227159 | A1 | 9/2009 | Meyer | |
| 2010/0326345 | A1 * | 12/2010 | Ohman | B63B 34/23 114/347 |
| 2012/0024211 | A1 | 2/2012 | Wiltse | |
| 2012/0164896 | A1 | 6/2012 | Kobayashi et al. | |

* cited by examiner

HULL OF A WATERCRAFT

CROSS-REFERENCE

The present application claims priority from U.S. Provisional Patent Application No. 62/908,514, filed on Sep. 30, 2019, and from U.S. Provisional Patent Application No. 62/929,004, filed on Oct. 31, 2019, each of which is incorporated herein by reference.

FIELD OF TECHNOLOGY

The present technology relates to the hulls of watercrafts.

BACKGROUND

The hull of a watercraft provides buoyancy and stability thereto. The hull can be made in a variety of ways including for example from welded sheets of aluminum, steel or other metallic materials, or in other cases from molded plastic. In some cases, a single-piece hull can be made from molded fiberglass.

However, these manufacturing methods can be labor intensive and thus expensive to implement. Furthermore, different sized hulls have to be used for watercrafts of different sizes which can be expensive for the manufacturer as additional tooling and/or significant amount of labor can be required to provide such a variety of hulls. Additionally, there is a logistical problem posed by having significant quantities of different sized hulls on hand to be able to offer the watercrafts of different sizes.

In view of the foregoing, there is a need for a watercraft having a hull that addresses at least some of these drawbacks.

SUMMARY

It is an object of the present technology to ameliorate at least some of the inconveniences present in the prior art.

According to an aspect of the present technology, there is provided a method of assembling a watercraft of a family of watercraft, including at least a first watercraft and a second watercraft. The method includes: providing a rear hull module comprising a rear hull panel defining a power pack portion configured to receive at least in part a power pack of the watercraft; providing a front hull module comprising a front hull panel defining at least in part a bow of the watercraft; providing a hull extension module comprising a hull extension panel. The method further includes, when assembling the first watercraft: attaching the front hull panel to the rear hull panel such that the front hull panel extends forwardly of the rear hull panel; the front hull panel and the rear hull panel forming a hull of the first watercraft and defining a substantially continuous running surface of the first watercraft, the first watercraft having a first hull length measured longitudinally between a front end of the front hull panel and a rear end of the rear hull panel. The method further includes, when assembling the second watercraft: attaching the hull extension panel to the rear hull panel such that the hull extension panel extends forwardly of the rear hull panel; and attaching the front hull panel to the hull extension panel such that the front hull panel extends forwardly of the hull extension panel, the front hull panel, the hull extension panel and the rear hull panel forming a hull of the second watercraft and defining a substantially continuous running surface of the second watercraft, the second watercraft having a second hull length measured longitudinally between the front end of the front hull panel and the rear end of the rear hull panel, the second hull length being greater than the first hull length.

In some embodiments, the hull extension module is a buoyant hull extension module.

In some embodiments, the hull extension module comprises at least one hull extension buoyant element; and the method further comprises, when assembling the second watercraft: positioning the at least one hull extension buoyant element at least partly atop the hull extension panel.

In some embodiments, a rear surface of the at least one hull extension buoyant element and a front surface of the rear hull panel have corresponding shapes.

In some embodiments, when assembling the second watercraft: an interface between the hull extension panel and the front hull panel is sealed below a water line of the second watercraft; and an interface between the hull extension panel and the rear hull panel is sealed below the water line of the second watercraft.

In some embodiments, the hull extension panel defines a hollow interior.

In some embodiments, the front hull panel defines a plurality of attachment features arranged in a first attachment pattern; the rear hull panel defines a plurality of attachment features arranged in the first attachment pattern; the hull extension panel defines a plurality of attachment features arranged in the first attachment pattern; attaching the front hull panel to the rear hull panel comprises: aligning the plurality of attachment features of the front hull panel with the plurality of attachment features of the rear hull panel; and fastening the front hull panel to the rear hull panel via the pluralities of attachment features of the front hull panel and the rear hull panel; and attaching the front hull panel to the hull extension panel comprises: aligning the plurality of attachment features of the front hull panel with the plurality of attachment features of the hull extension panel; and fastening the front hull panel to the hull extension panel via the pluralities of attachment features of the front hull panel and the hull extension panel.

In some embodiments, the plurality of attachment features of the rear hull panel is a plurality of first attachment features of the rear hull panel; the plurality of attachment features of the hull extension panel is a plurality of first attachment features of the hull extension panel; the rear hull panel defines a plurality of second attachment features arranged in a second attachment pattern; the hull extension panel defines a plurality of second attachment features arranged in the second attachment pattern; and attaching the hull extension panel to the rear hull panel comprises: aligning the plurality of second attachment features of the hull extension panel with the plurality of second attachment features of the rear hull panel; and fastening the hull extension panel to the rear hull panel via the pluralities of second attachment features of the hull extension panel and the rear hull panel.

In some embodiments, the plurality of attachment features of the front hull panel is a plurality of openings; the plurality of attachment features of the rear hull panel is a plurality of openings; the plurality of attachment features of the hull extension panel is a plurality of openings; fastening the front hull panel to the rear hull panel comprises: inserting a plurality of fasteners into the pluralities of openings of the front hull panel and the rear hull panel; and fastening the front hull panel to the hull extension panel comprises: inserting a plurality of fasteners into the pluralities of openings of the front hull panel and the hull extension panel.

In some embodiments, the plurality of first attachment features of the rear hull panel is a plurality of first openings;

the plurality of first attachment features of the hull extension panel is a plurality of first openings; the plurality of second attachment features of the rear hull panel is a plurality of second openings; the plurality of second attachment features of the hull extension panel is a plurality of second openings; and fastening the hull extension panel to the rear hull panel comprises: inserting a plurality of fasteners into the pluralities of second openings of the hull extension panel and the rear hull panel.

In some embodiments, the rear hull module further comprises a rear hull cover; and the method further comprises, when assembling either one of the first watercraft and the second watercraft: positioning the power pack at least partly between the rear hull panel and the rear hull cover so that the power pack is at least partly enclosed therebetween.

In some embodiments, the method further comprises: when assembling the first watercraft: installing a first deck that extends over the front hull module and the rear hull module; and when assembling the second watercraft: installing a second deck that extends over the front hull module, the rear hull module and the hull extension module.

In some embodiments, the family of watercraft includes a third watercraft; the hull extension module is a first hull extension module and the hull extension panel is a first hull extension panel; the method further comprises: providing a second hull extension module comprising a second hull extension panel; when assembling the third watercraft: attaching the second hull extension panel to the rear hull panel such that the second hull extension panel extends forwardly of the rear hull panel; attaching the first hull extension panel to the second hull extension panel such that the first hull extension panel extends forwardly of the second hull extension panel; and attaching the front hull panel to the first hull extension panel such that the front hull panel extends forwardly of the first hull extension panel, the front hull panel, the first hull extension panel, the second hull extension panel and the rear hull panel forming a hull of the third watercraft and defining a substantially continuous running surface of the third watercraft, the third watercraft having a third hull length measured longitudinally between the front end of the front hull panel and the rear end of the rear hull panel, the third hull length being greater than the second hull length.

In some embodiments, the first hull extension module is a buoyant first hull extension module; and the second hull extension module is a buoyant second hull extension module.

In some embodiments, the first hull extension module comprises at least one first hull extension buoyant element; the second hull extension module comprises at least one second hull extension buoyant element; and the method further comprises, when assembling the second watercraft: positioning the at least one first hull extension buoyant element atop the first hull extension panel; and when assembling the third watercraft: positioning the at least one second hull extension buoyant element atop at least one of the first hull extension panel and the second hull extension panel.

In some embodiments, when assembling the third watercraft: an interface between the second hull extension panel and the first hull extension panel is sealed below a water line of the third watercraft; and an interface between the second hull extension panel and the rear hull panel is sealed below the water line of the third watercraft.

In some embodiments, the second hull extension panel defines a hollow interior.

In some embodiments, positioning the at least one second hull extension buoyant element comprises: positioning the at least one second hull extension buoyant element rearwardly of the at least one first hull extension buoyant element.

In some embodiments, a front surface of the at least one second hull extension buoyant element and a rear surface of the at least one first hull extension buoyant element have corresponding shapes.

In some embodiments, the front hull panel defines a plurality of attachment features arranged in a first attachment pattern; the rear hull panel defines a plurality of attachment features arranged in the first attachment pattern; the first hull extension panel defines a plurality of attachment features arranged in the first attachment pattern; attaching the front hull panel to the rear hull panel comprises: aligning the plurality of attachment features of the front hull panel with the plurality of attachment features of the rear hull panel; and fastening the front hull panel to the rear hull panel via the pluralities of attachment features of the front hull panel and the rear hull panel; and attaching the front hull panel to the first hull extension panel comprises: aligning the plurality of attachment features of the front hull panel with the plurality of attachment features of the first hull extension panel; and fastening the front hull panel to the first hull extension panel via the pluralities of attachment features of the front hull panel and the first hull extension panel.

In some embodiments, the plurality of attachment features of the rear hull panel is a plurality of first attachment features of the rear hull panel; the plurality of attachment features of the first hull extension panel is a plurality of first attachment features of the first hull extension panel; the rear hull panel defines a plurality of second attachment features arranged in a second attachment pattern; the first hull extension panel defines a plurality of second attachment features arranged in the second attachment pattern; the second hull extension panel defines: a first plurality of second attachment features arranged in the second attachment pattern; and a second plurality of second attachment features arranged in the second attachment pattern; attaching the second hull extension panel to the rear hull panel comprises: aligning the first plurality of second attachment features of the second hull extension panel with the plurality of second attachment features of the rear hull panel; and fastening the second hull extension panel to the rear hull panel via the plurality of second attachment features of the rear hull panel and the first plurality of second attachment features of the second hull extension panel; and attaching the first hull extension panel to the second hull extension panel comprises: aligning the second plurality of second attachment features of the second hull extension panel with the plurality of second attachment features of the first hull extension panel; and fastening the first hull extension panel to the second hull extension panel via the plurality of second attachment features of the first hull extension panel and of the second plurality of second attachment features of the second hull extension panel.

In some embodiments, the plurality of attachment features of the front hull panel is a plurality of openings; the plurality of attachment features of the rear hull panel is a plurality of openings; the plurality of attachment features of the first hull extension panel is a plurality of openings; fastening the front hull panel to the rear hull panel comprises: inserting a plurality of fasteners into the pluralities of openings of the front hull panel and the rear hull panel; and fastening the front hull panel to the first hull extension panel comprises: inserting a plurality of fasteners into the pluralities of openings of the front hull panel and the first hull extension panel.

In some embodiments, the plurality of first attachment features of the rear hull panel is a plurality of first openings;

the plurality of first attachment features of the first hull extension panel is a plurality of first openings; the plurality of second attachment features of the rear hull panel is a plurality of second openings; the plurality of second attachment features of the first hull extension panel is a plurality of second openings; the first plurality of second attachment features of the second hull extension panel is a first plurality of second openings; the second plurality of second attachment features of the second hull extension panel is a second plurality of second openings; fastening the second hull extension panel to the rear hull panel comprises: inserting a plurality of fasteners into the plurality of second openings of the rear hull panel and into the first plurality of second openings of the second hull extension panel; and fastening the first hull extension panel to the second hull extension panel comprises: inserting a plurality of fasteners into the plurality of second openings of the first hull extension panel and into the second plurality of second openings of the second hull extension panel.

In some embodiments, the hull of the first watercraft is a central hull of the first watercraft; the hull of the second watercraft is a central hull of the second watercraft; and the method further comprises: providing a first lateral hull and a second lateral hull; when assembling any of the first watercraft and the second watercraft: attaching the first lateral hull to the central hull on a first lateral side thereof; and attaching the second lateral hull to the central hull on a second lateral side thereof.

In some embodiments, attaching the front hull panel to the rear hull panel comprises: positioning a rear portion of the front hull panel below a front portion of the rear hull panel.

In some embodiments, attaching the hull extension panel to the rear hull panel comprises positioning a rear portion of the hull extension panel below a front portion of the rear hull panel; and attaching the front hull panel to the hull extension panel comprises positioning a rear portion of the front hull panel below a front portion of the hull extension panel.

In some embodiments, attaching the second hull extension panel to the rear hull panel comprises positioning a rear portion of the second hull extension panel below a front portion of the rear hull panel; and attaching the first hull extension panel to the second hull extension panel comprises positioning a rear portion of the first hull extension panel below a front portion of the second hull extension panel.

According to another aspect of the present technology, there is provided a system for assembling a watercraft of a family of watercraft, including at least a first watercraft and a second watercraft. The system includes: a rear hull module comprising a rear hull panel defining a power pack portion configured to receive at least in part a power pack of the watercraft; a front hull module comprising a front hull panel defining at least in part a bow of the watercraft; a hull extension module comprising a hull extension panel. When the first watercraft is assembled: the front hull panel is attached to the rear hull panel such that the front hull panel extends forward of the rear hull panel; the front hull panel and the rear hull panel form a hull of the first watercraft and define a substantially continuous running surface of the first watercraft; and the first watercraft has a first hull length measured longitudinally between a front end of the front hull panel and a rear end of the rear hull panel. When the second watercraft is assembled: the hull extension panel is attached to the rear hull panel such that the hull extension panel extends forwardly of the rear hull panel; the front hull panel is attached to the hull extension panel such that the front hull panel extends forwardly of the hull extension panel; the front hull panel, the hull extension panel and the rear hull panel form a hull of the watercraft and define a substantially continuous running surface of the second watercraft, the second watercraft has a second hull length measured longitudinally between the front end of the front hull panel and the rear end of the rear hull panel; and the second hull length is greater than the first hull length.

In some embodiments, the hull extension module is a buoyant hull extension module.

In some embodiments, the hull extension module comprises at least one hull extension buoyant element; and when the second watercraft is assembled: the at least one hull extension buoyant element is positioned at least partly atop the hull extension panel.

In some embodiments, a rear surface of the at least one hull extension buoyant element and a front surface of the rear hull panel have corresponding shapes.

In some embodiments, when the second watercraft is assembled: an interface between the hull extension panel and the front hull panel is sealed below a water line of the second watercraft; and an interface between the hull extension panel and the rear hull panel is sealed below the water line of the second watercraft.

In some embodiments, the hull extension panel defines a hollow interior.

In some embodiments, the front hull panel defines a plurality of attachment features arranged in a first attachment pattern; the rear hull panel defines a plurality of attachment features arranged in the first attachment pattern; the hull extension panel defines a plurality of attachment features arranged in the first attachment pattern; when the first watercraft is assembled: the plurality of attachment features of the front hull panel is aligned with the plurality of attachment features of the rear hull panel; and the front hull panel is fastened to the rear hull panel via the pluralities of attachment features of the front hull panel and the rear hull panel; and when the second watercraft is assembled: the plurality of attachment features of the front hull panel is aligned with the plurality of attachment features of the hull extension panel; and the front hull panel is fastened to the hull extension panel via the pluralities of attachment features of the front hull panel and the hull extension panel.

In some embodiments, the plurality of attachment features of the rear hull panel is a plurality of first attachment features of the rear hull panel; the plurality of attachment features of the hull extension panel is a plurality of first attachment features of the hull extension panel;

the rear hull panel defines a plurality of second attachment features arranged in a second attachment pattern; the hull extension panel defines a plurality of second attachment features arranged in the second attachment pattern; and when the second watercraft is assembled: the plurality of second attachment features of the hull extension panel is aligned with the plurality of second attachment features of the rear hull panel; and the hull extension panel is fastened to the rear hull panel via the pluralities of second attachment features of the hull extension panel and the rear hull panel.

In some embodiments, the plurality of attachment features of the front hull panel is a plurality of openings; the plurality of attachment features of the rear hull panel is a plurality of openings; the plurality of attachment features of the hull extension panel is a plurality of openings; when the first watercraft is assembled: the front hull panel is fastened to the rear hull panel by a plurality of fasteners inserted into the pluralities of openings of the front hull panel and the rear hull panel; and when the second watercraft is assembled: the front hull panel is fastened to the hull extension panel by a plurality of fasteners inserted into the pluralities of openings of the front hull panel and the hull extension panel.

In some embodiments, the plurality of first attachment features of the rear hull panel is a plurality of first openings; the plurality of first attachment features of the hull extension panel is a plurality of first openings; the plurality of second attachment features of the rear hull panel is a plurality of second openings; the plurality of second attachment features of the hull extension panel is a plurality of second openings; when the second watercraft is assembled: the hull extension panel is fastened to the rear hull panel by a plurality of fasteners inserted into the pluralities of second openings of the hull extension panel and the rear hull panel.

In some embodiments, the rear hull module further comprises a rear hull cover; and when either one of the first watercraft and the second watercraft is assembled: the power pack is positioned at least partly between the rear hull panel and the rear hull cover so that the power pack is at least partly enclosed therebetween.

In some embodiments, when the first watercraft is assembled: a first deck extends over the front hull module and the rear hull module; and when the second watercraft is assembled: a second deck extends over the front hull module, the rear hull module and the hull extension module.

In some embodiments, the family of watercraft includes a third watercraft; the hull extension module is a first hull extension module and the hull extension panel is a first hull extension panel; the system further comprises: a buoyant hull extension module comprising a second hull extension panel; when the third watercraft is assembled: the second hull extension panel is attached to the rear hull panel such that the second hull extension panel extends forwardly of the rear hull panel; the first hull extension panel is attached the second hull extension panel such that the first hull extension panel extends forwardly of the second hull extension panel; and the front hull panel is attached to the first hull extension panel such that the front hull panel extends forwardly of the first hull extension panel, the front hull panel, the first hull extension panel, the second hull extension panel and the rear hull panel form a hull of the third watercraft and define a substantially continuous running surface of the third watercraft, the third watercraft has a third hull length measured longitudinally between the front end of the front hull panel and the rear end of the rear hull panel, the third hull length is greater than the second hull length.

In some embodiments, the first hull extension module is a buoyant first hull extension module; and the second hull extension module is a buoyant second hull extension module.

In some embodiments, the first hull extension module comprises at least one first hull extension buoyant element; the second hull extension module comprises at least one second hull extension buoyant element; when the second watercraft is assembled: the at least one first hull extension buoyant element is positioned atop the first hull extension panel; and when the third watercraft is assembled: the at least one second hull extension buoyant element is positioned atop at least one of the first hull extension panel and the second hull extension panel.

In some embodiments, when the third watercraft is assembled: an interface between the second hull extension panel and the first hull extension panel is sealed below a water line of the third watercraft; and an interface between the second hull extension panel and the rear hull panel is sealed below the water line of the third watercraft.

In some embodiments, the second hull extension panel defines a hollow interior.

In some embodiments, when the third watercraft is assembled: the at least one second hull extension buoyant element is positioned rearwardly of the at least one first hull extension buoyant element.

In some embodiments, a front surface of the at least one second hull extension buoyant element and a rear surface of the at least one first hull extension buoyant element have corresponding shapes.

In some embodiments, the front hull panel defines a plurality of attachment features arranged in a first attachment pattern; the rear hull panel defines a plurality of attachment features arranged in the first attachment pattern; the first hull extension panel defines a plurality of attachment features arranged in the first attachment pattern; when the first watercraft is assembled: the plurality of attachment features of the front hull panel is aligned with the plurality of attachment features of the rear hull panel; and the front hull panel is fastened to the rear hull panel via the pluralities of attachment features of the front hull panel and the rear hull panel; and when the second watercraft is assembled: the plurality of attachment features of the front hull panel are aligned with the plurality of attachment features of the first hull extension panel; and the front hull panel is fastened to the first hull extension panel via the pluralities of attachment features of the front hull panel and the first hull extension panel.

In some embodiments, the plurality of attachment features of the rear hull panel is a plurality of first attachment features of the rear hull panel; the plurality of attachment features of the first hull extension panel is a plurality of first attachment features of the first hull extension panel; the rear hull panel defines a plurality of second attachment features arranged in a second attachment pattern; the first hull extension panel defines a plurality of second attachment features arranged in the second attachment pattern; the second hull extension panel defines: a first plurality of second attachment features arranged in the second attachment pattern; and a second plurality of second attachment features arranged in the second attachment pattern; when the third watercraft is assembled: the first plurality of second attachment features of the second hull extension panel is aligned with the plurality of second attachment features of the rear hull panel; and the second hull extension panel is fastened to the rear hull panel via the plurality of second attachment features of the rear hull panel and the first plurality of second attachment features of the second hull extension panel; the second plurality of second attachment features of the second hull extension panel is aligned with the plurality of second attachment features of the first hull extension panel; and the first hull extension panel is fastened to the second hull extension panel via the plurality of second attachment features of the first hull extension panel and the second plurality of second attachment features of the second hull extension panel.

In some embodiments, the plurality of attachment features of the front hull panel is a plurality of openings; the plurality of attachment features of the rear hull panel is a plurality of openings; the plurality of attachment features of the first hull extension panel is a plurality of openings; when the first watercraft is assembled: the front hull panel is fastened to the rear hull panel by a plurality of fasteners inserted into the pluralities of openings of the front hull panel and the rear hull panel; and when the second watercraft is assembled: the front hull panel is fastened to the first hull extension panel by a plurality of fasteners inserted into the pluralities of openings of the front hull panel and the first hull extension panel.

In some embodiments, the plurality of first attachment features of the rear hull panel is a plurality of first openings; the plurality of first attachment features of the first hull extension panel is a plurality of first openings; the plurality of second attachment features of the rear hull panel is a plurality of second openings; the first plurality of second attachment features of the second hull extension panel is a first plurality of second openings; the second plurality of second attachment features of the second hull extension panel is a second plurality of second openings; and when the third watercraft is assembled: the second hull extension panel is fastened to the rear hull panel by a plurality of fasteners inserted into the plurality of second openings of the rear hull panel and into the first plurality of second openings of the second hull extension panel; and the first hull extension panel is fastened to the second hull extension panel by a plurality of fasteners inserted into the plurality of second openings of the first hull extension panel and into the second plurality of second openings of the second hull extension panel.

In some embodiments, the hull of the first watercraft is a central hull of the first watercraft; the hull of the second watercraft is a central hull of the second watercraft; the system further comprises a first lateral hull and a second lateral hull; when any of the first watercraft and the second watercraft are assembled: the first lateral hull is attached to the central hull on a first lateral side thereof; and the second lateral hull is attached to the central hull on a second lateral side thereof.

In some embodiments, when the first watercraft is assembled, a rear portion of the front hull panel is positioned below a front portion of the rear hull panel.

In some embodiments, the second watercraft is assembled: a rear portion of the hull extension panel is positioned below a front portion of the rear hull panel; and a rear portion of the front hull panel is positioned below a front portion of the hull extension panel.

In some embodiments, when the third watercraft is assembled: a rear portion of the second hull extension panel is positioned below a front portion of the rear hull panel; and a rear portion of the first hull extension panel is positioned below a front portion of the second hull extension panel.

According to another aspect of the present technology, there is provided a watercraft. The watercraft includes: a deck; a hull supporting the deck, the hull comprising: a rear hull panel defining a power pack portion; a buoyant hull extension module attached to the rear hull panel such that the buoyant hull extension module extends forwardly of the rear hull panel; a front hull panel defining at least in part a bow of the watercraft, the front hull panel being attached to the buoyant hull extension module such that the front hull panel extends forwardly of the buoyant hull extension module; and a power pack at least partly disposed in the power pack portion of the rear hull panel.

In some embodiments, the buoyant hull extension module comprises a hull extension panel; the hull extension panel is attached to the rear hull panel such that the hull extension panel extends forwardly of the rear hull panel; and the front hull panel is attached to the hull extension panel such that front hull panel extends forwardly of the hull extension panel.

In some embodiments, the buoyant hull extension module further comprises: at least one hull extension buoyant element positioned at least partly atop the hull extension panel.

In some embodiments, a rear surface of the at least one hull extension buoyant element and a front surface of the rear hull panel have corresponding shapes.

In some embodiments, the front hull panel defines a plurality of attachment features arranged in a first attachment pattern; the hull extension panel defines a plurality of attachment features arranged in the first attachment pattern; and the front hull panel is fastened to the hull extension panel via the pluralities of attachment features of the front hull panel and the hull extension panel.

In some embodiments, the plurality of attachment features of the hull extension panel is a plurality of first attachment features; the hull extension panel comprises a plurality of second attachment features arranged in a second attachment pattern; the rear hull panel defines a plurality of second attachment features arranged in the second attachment pattern; and the hull extension panel is attached to the rear hull panel via the pluralities of second openings of the hull extension panel and the rear hull panel.

In some embodiments, the plurality of attachment features of the front hull panel is a plurality of openings; the plurality of attachment features of the hull extension panel is a plurality of openings; and a plurality of fasteners is inserted into the pluralities of openings of the front hull panel and the hull extension panel.

In some embodiments, the plurality of second attachment features of the hull extension panel is a plurality of second openings; the plurality of second attachment features of the rear hull panel is a plurality of second openings; and a plurality of fasteners is inserted into the pluralities of second openings of the hull extension panel and the rear hull panel.

In some embodiments, the watercraft further includes a rear hull cover disposed atop the rear hull panel, the power pack being at least partly between the rear hull panel and the rear hull cover so that the power pack is at least partly enclosed therebetween.

In some embodiments, the deck extends over the front hull panel, the rear hull panel and the buoyant hull extension module.

In some embodiments, the buoyant hull extension module is a first buoyant hull extension module; the watercraft further comprises a second buoyant hull extension module, the first hull extension panel being attached to the rear hull extension panel via the second hull extension module; the second hull extension module is attached to the rear hull panel such that the second hull extension module extends forwardly of the rear hull panel; and the first hull extension module is attached to the second hull extension module such that the first hull extension module extends forwardly of the second hull extension module.

In some embodiments, the first buoyant hull extension module comprises a first hull extension panel; the second buoyant hull extension hull extension module comprises a second hull extension panel; the second hull extension panel is attached to the rear hull panel such that the second hull extension panel extends forwardly of the rear hull panel; the first hull extension panel is attached to the second hull extension panel such that the first hull extension panel extends forwardly of the second hull extension panel; and the front hull panel is attached to the first hull extension panel such that the front hull panel extends forwardly of the first hull extension panel.

In some embodiments, the first hull extension module comprises at least one first hull extension buoyant element positioned atop the first hull extension panel; the second hull extension module comprises at least one second hull extension buoyant element positioned atop at least one of the first hull extension panel and the second hull extension panel.

In some embodiments, the at least one of the first hull extension panel and the second hull extension panel is the first hull extension panel.

In some embodiments, the at least one second hull extension buoyant element is positioned rearwardly of the at least one first hull extension buoyant element.

In some embodiments, a front surface of the at least one second hull extension buoyant element and a rear surface of the at least one first hull extension buoyant element have corresponding shapes.

In some embodiments, the front hull panel defines a plurality of first attachment features arranged in a first attachment pattern; the first hull extension panel defines: a plurality of first attachment features arranged in the first attachment pattern; a plurality of second attachment features arranged in a second attachment pattern; the second hull extension panel defines: a first plurality of second attachment features arranged in the second attachment pattern; and a second plurality of second attachment features arranged in the second attachment pattern; the rear hull panel defines a plurality of second attachment features arranged in the second attachment pattern; the front hull panel is fastened to the first hull extension panel via the pluralities of first attachment features of the front hull panel and the first hull extension panel; the first hull extension panel is fastened to the second hull extension panel via the plurality of second attachment features of the first hull extension panel and the first plurality of second attachment features of the second hull extension panel; and the second hull extension panel is fastened to the rear hull panel via the plurality of second attachment features of the rear hull panel and the second plurality of second attachment features of the second hull extension panel.

In some embodiments, the plurality of first attachment features of the front hull panel is a plurality of first openings; the plurality of first attachment features of the first hull extension panel is a plurality of first openings; the plurality of second attachment features of the first extensional panel is a plurality of second openings; the first plurality of second attachment features of the second hull extension panel is a first plurality of second openings; the second plurality of second attachment features of the second hull extension panel is a second plurality of second openings; the plurality of second attachment features of the rear hull panel is a plurality of second openings; a first plurality of fasteners is inserted into the pluralities of first openings of the front hull panel and the first hull extension panel; a second plurality of fasteners is inserted into the plurality of second openings of the first hull extension panel and into the first plurality of second openings of the second hull extension panel; and a third plurality of fasteners is inserted into the plurality of second openings of the rear hull opening and into the second plurality of second openings of the second hull extension panel.

In some embodiments, the deck extends over the front hull panel, the hull extension module and the rear hull panel.

In some embodiments, the hull is a central hull; the watercraft further comprises: a first lateral hull; and a second lateral hull, each of the first and second lateral hulls supporting part of the deck; and the central hull is disposed laterally between the first lateral hull and the second lateral hull.

In some embodiments, the watercraft further includes a rear bumper connected to and extending rearwardly from the rear hull panel.

In some embodiments, a rear portion of the hull extension panel is positioned below a front portion of the rear hull panel; and a rear portion of the front hull panel is positioned below a front portion of the hull extension panel.

In some embodiments, a rear portion of the second hull extension panel is positioned below a front portion of the rear hull panel; and a rear portion of the first hull extension panel is positioned below a front portion of the second hull extension panel.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
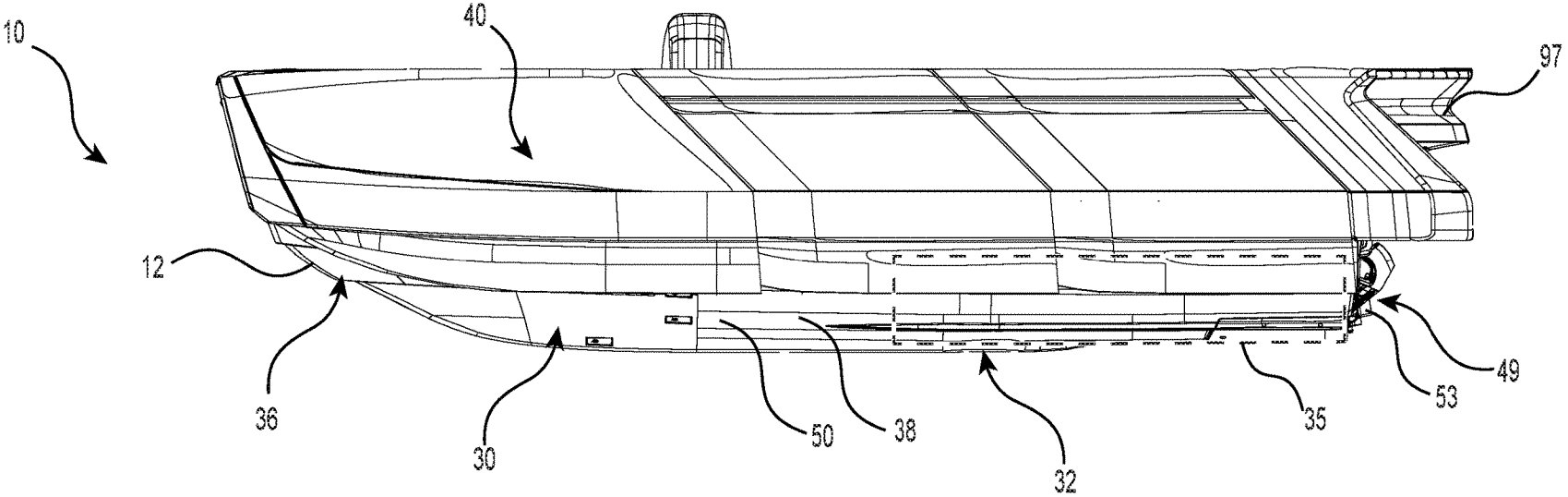
FIG. 1 is a left side elevation view of a pontoon boat of a family of pontoon boats, in accordance with an embodiment of the present technology.

In accordance with the present technology, various watercrafts 10, 10', 10" of a family of watercrafts can be assembled while having many of the same modular components. In accordance with one embodiment of the present technology, the watercrafts 10, 10', 10" are pontoon boats 10, 10', 10". Those of ordinary skill in the art will recognize that there are other known types of watercrafts incorporating different designs and that the present technology would encompass these other watercrafts.

The boat 10 in accordance with one embodiment of the present technology is shown in FIGS. 1 to 4. The following description relates to one example of a watercraft 10, notably a pontoon boat 10.

In this embodiment, the boat 10 is a multihull watercraft, notably having a central hull 30, a left hull 40 and a right hull 40. The left and right hulls 40 are laterally spaced apart from one another and are separated by the central hull 30 that is laterally centered therebetween and to which both the left and right hulls 40 are connected. As such, in this embodiment, the boat 10 has three distinct hulls. It is contemplated that, in other embodiments, the boat 10 may not be a multihull watercraft and may instead have a single hull, such as the central hull 30.

A deck 20 extends above the left hull 40, the right hull 40 and the central hull 30 and is supported thereby. The deck 20 has an upper surface 24 for supporting occupants, as well as accessories and accommodations of the boat 10 (e.g., seating, a command console with vessel controls such as steering and throttle controls, etc.) that have been omitted for clarity. In this embodiment, as best seen in FIG. 1, the deck 20 includes a plurality of tiles 22 which are configured for attachment of accessories thereto. The tiles 22 form a portion of the upper surface 24 of the deck 20. Notably, a number of the tiles 22 extend over the left hull 40, some over the right hull 40 and some others over the central hull 30.

Figure 3:
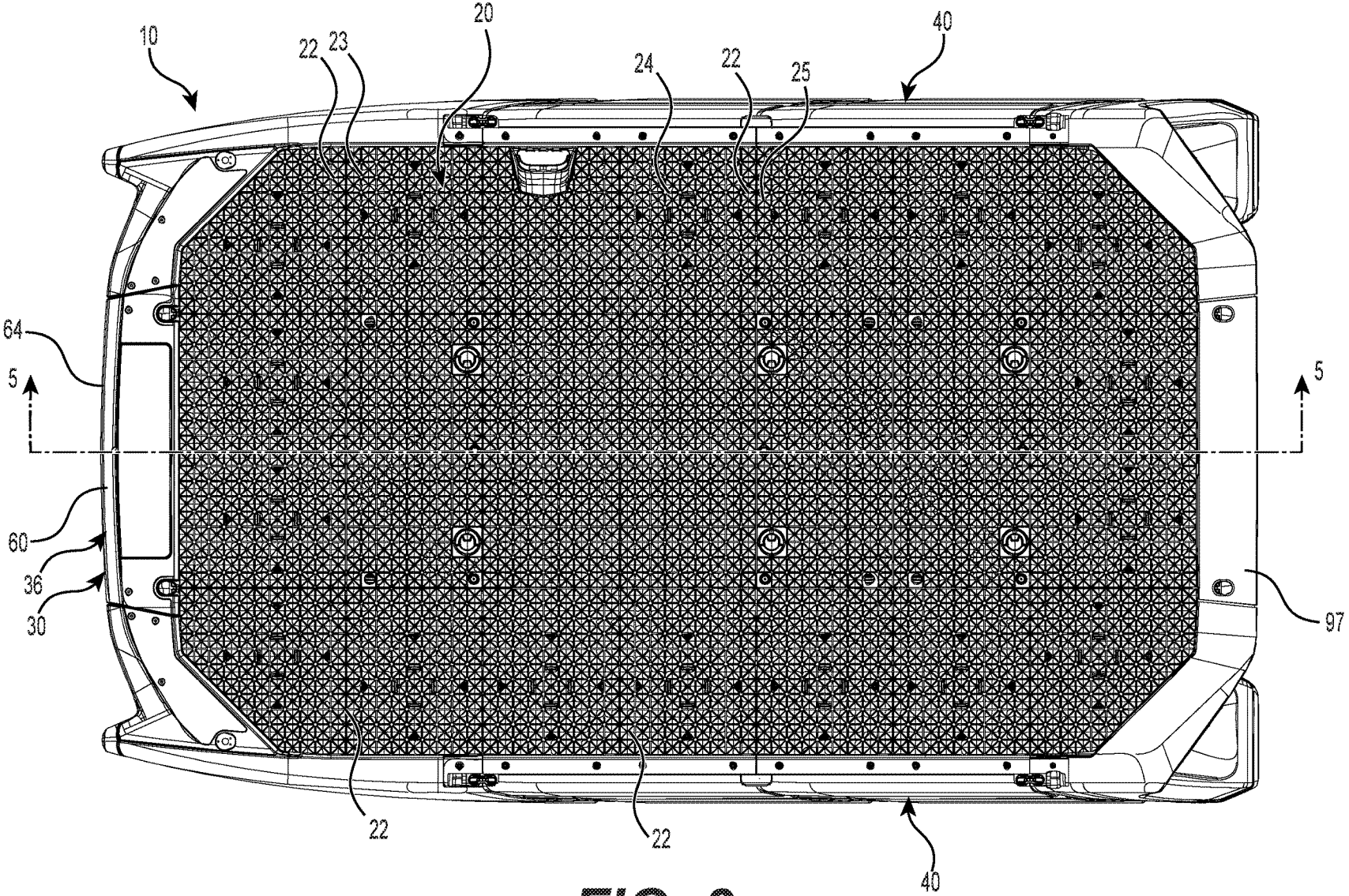
FIG. 3 is a top plan view of the pontoon boat of FIG. 1.

The tiles 22 can have various shapes in accordance with their position on the deck 20. For instance, as can be seen in FIG. 3, some of the tiles 22 along the periphery of the deck 20 are triangular to conform to an angular shape of the periphery of the boat 10. In other cases, some of the tiles 22 are generally rectangular. Each of the tiles 22 has a gripping texture 25 formed on its upper surface 23. In this embodiment, the gripping texture 25 consists of a repeating triangular pattern. The gripping texture 25 may have a different pattern in other embodiments.

A more detailed description of the configuration of the tiles 22 and the manner in which they are used for attachment of accessories can be found in U.S. patent application Ser. No. 16/887,481, filed May 29, 2020, which is incorporated herein by reference.

It is contemplated that the deck 20 could have a different construction than that provided by the tiles 22. For instance, the deck 20 could have a more conventional construction such as including a metallic frame and an overlying flooring layer, such as wooden panels or plywood.

Figure 19A:
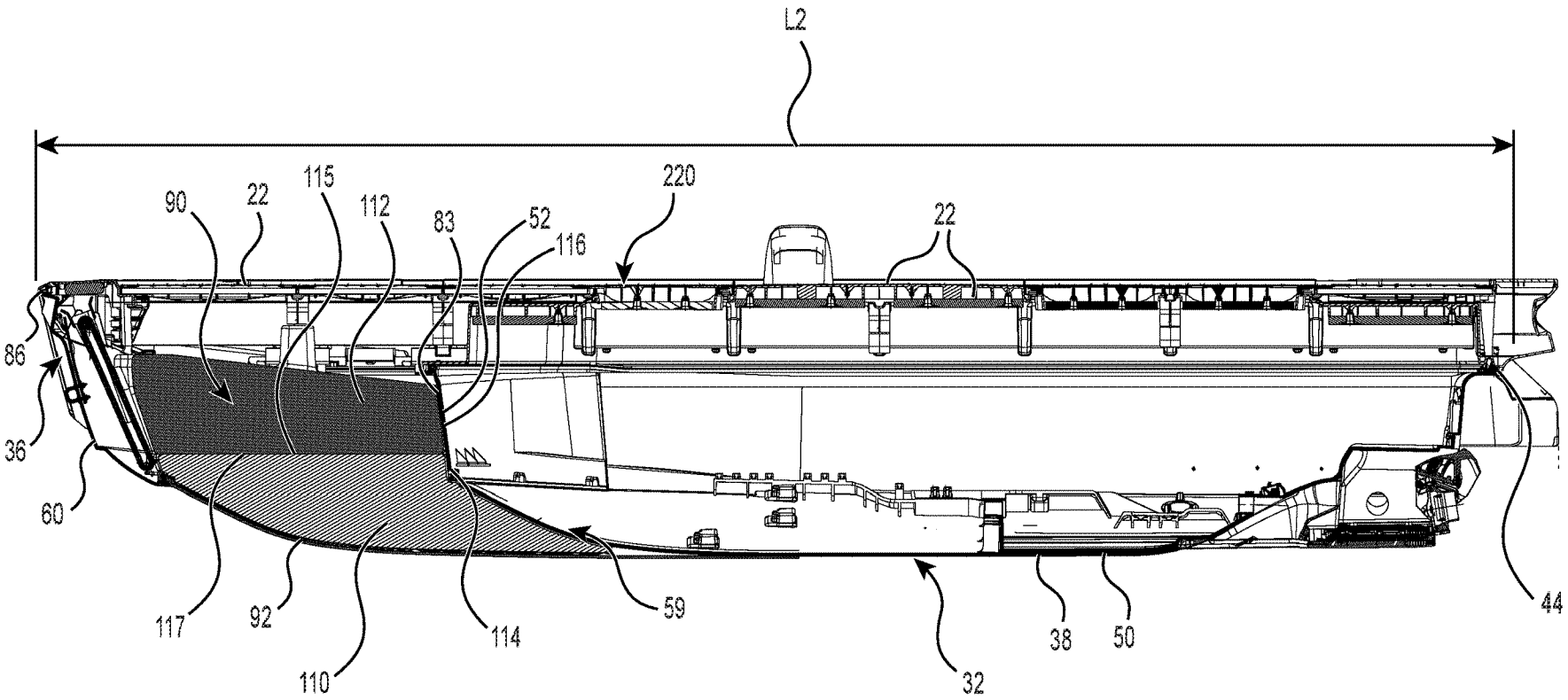
FIG. 19A is a cross-sectional view of the pontoon boat of FIG. 16 taken along line 19A-19A in FIG. 17 with internal components removed.
Figure 19B:
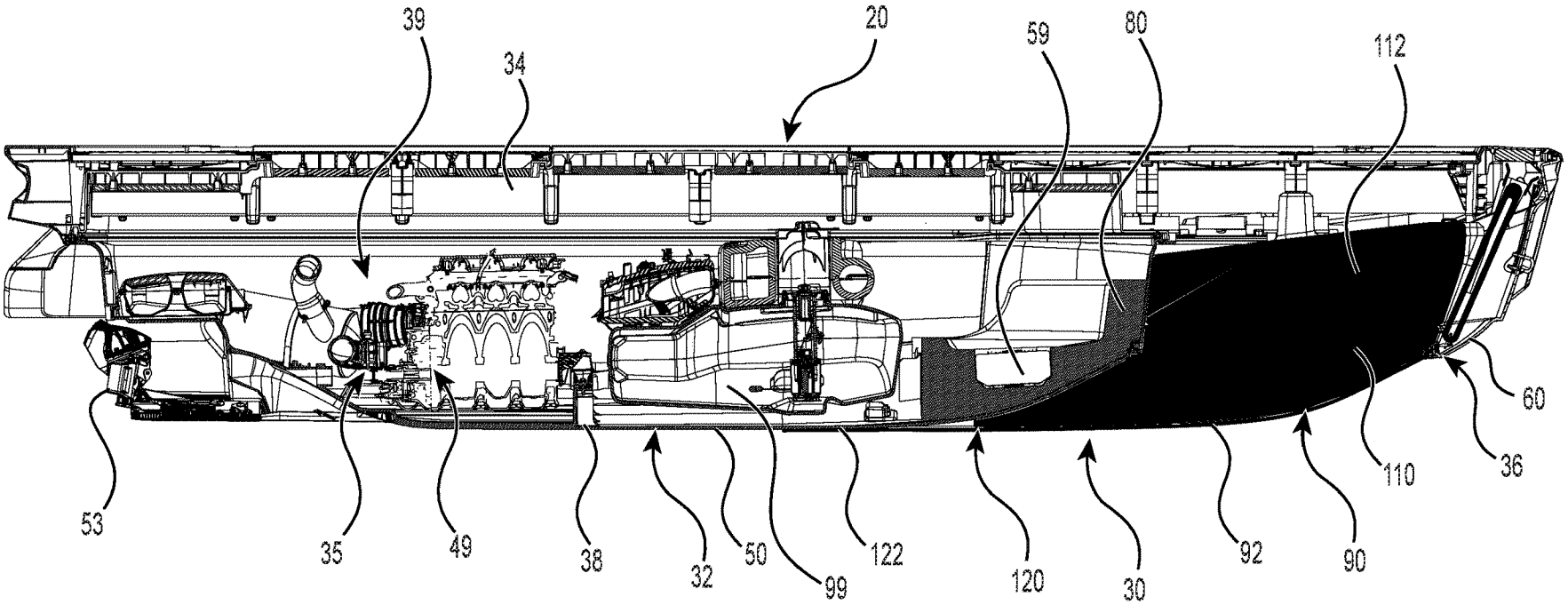
FIG. 19B is a cross-sectional view of the pontoon boat of FIG. 16 taken along line 19B-19B in FIG. 17.

The boat 10 is propelled by a jet propulsion system 49 (shown in greater detail in the cross-section of the boat 10' illustrated in FIG. 19B) powered by a motor 99. The jet propulsion system 49 has a steering nozzle 53 used for steering the boat 10. A handlebar (not shown) is operatively connected to the steering nozzle 53. A throttle lever (not shown) is operatively connected to the motor for controlling operation of the motor. The handlebar and the throttle lever are located on a command console provided on the deck 20. The command console is not shown in the figures in order to properly show the upper surface 24 of the deck 20. It is contemplated that other propulsion systems, such as a stern drive or a marine outboard engine, may be used to propel the boat 10. It is also contemplated that the handlebar could be replaced by a steering wheel and that the steering nozzle 53 could be replaced by an outdrive or one or more rudders.

A power pack 35 (schematically illustrated in FIG. 1) of the boat 10, including the jet propulsion system 49 and the motor 99, is enclosed in part by the central hull 30.

Figure 6:
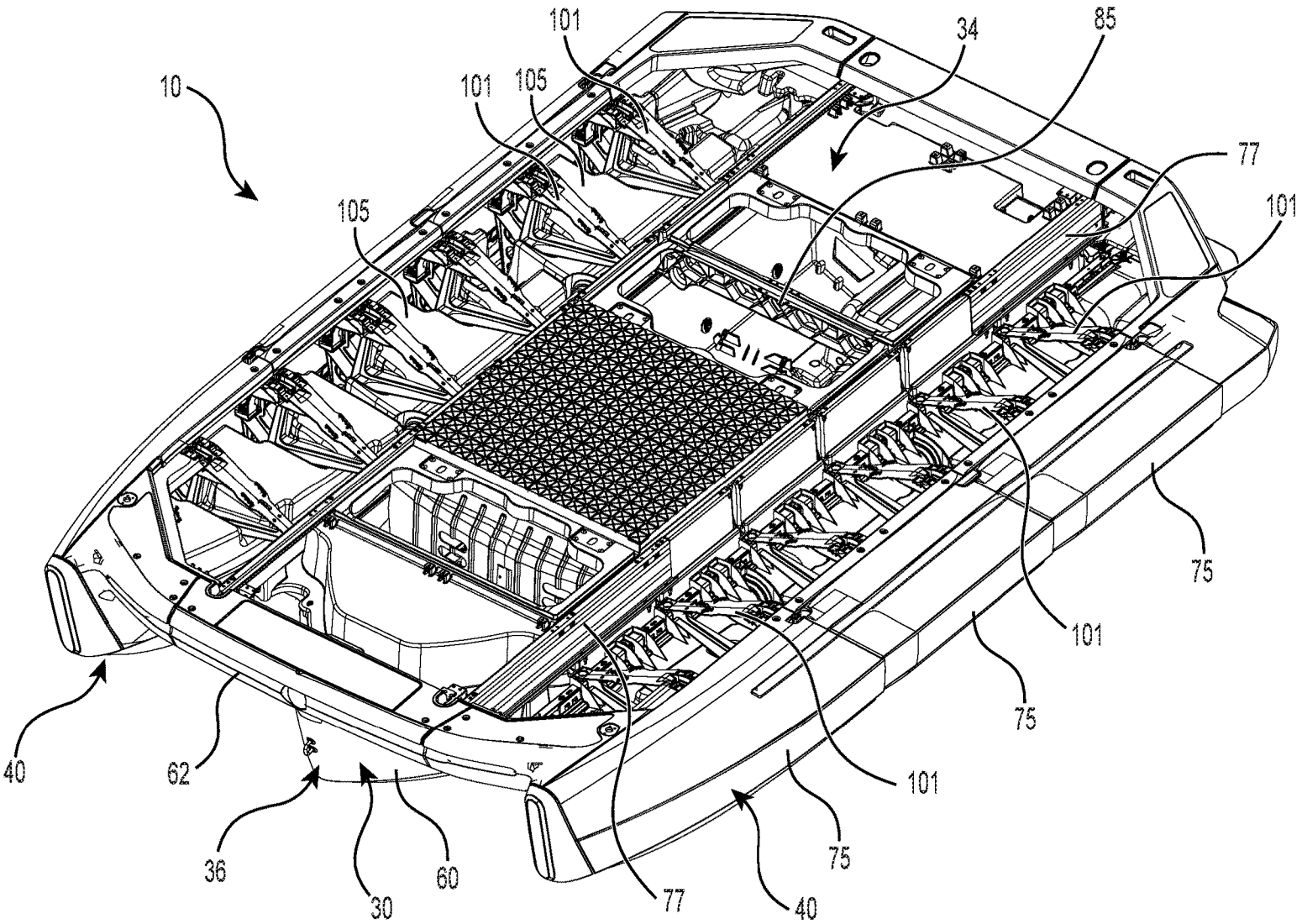
FIG. 6 is a perspective view, taken from a front left side, of the pontoon boat of FIG. 1 with part of a deck thereof removed to expose underlying components.
Figure 7:
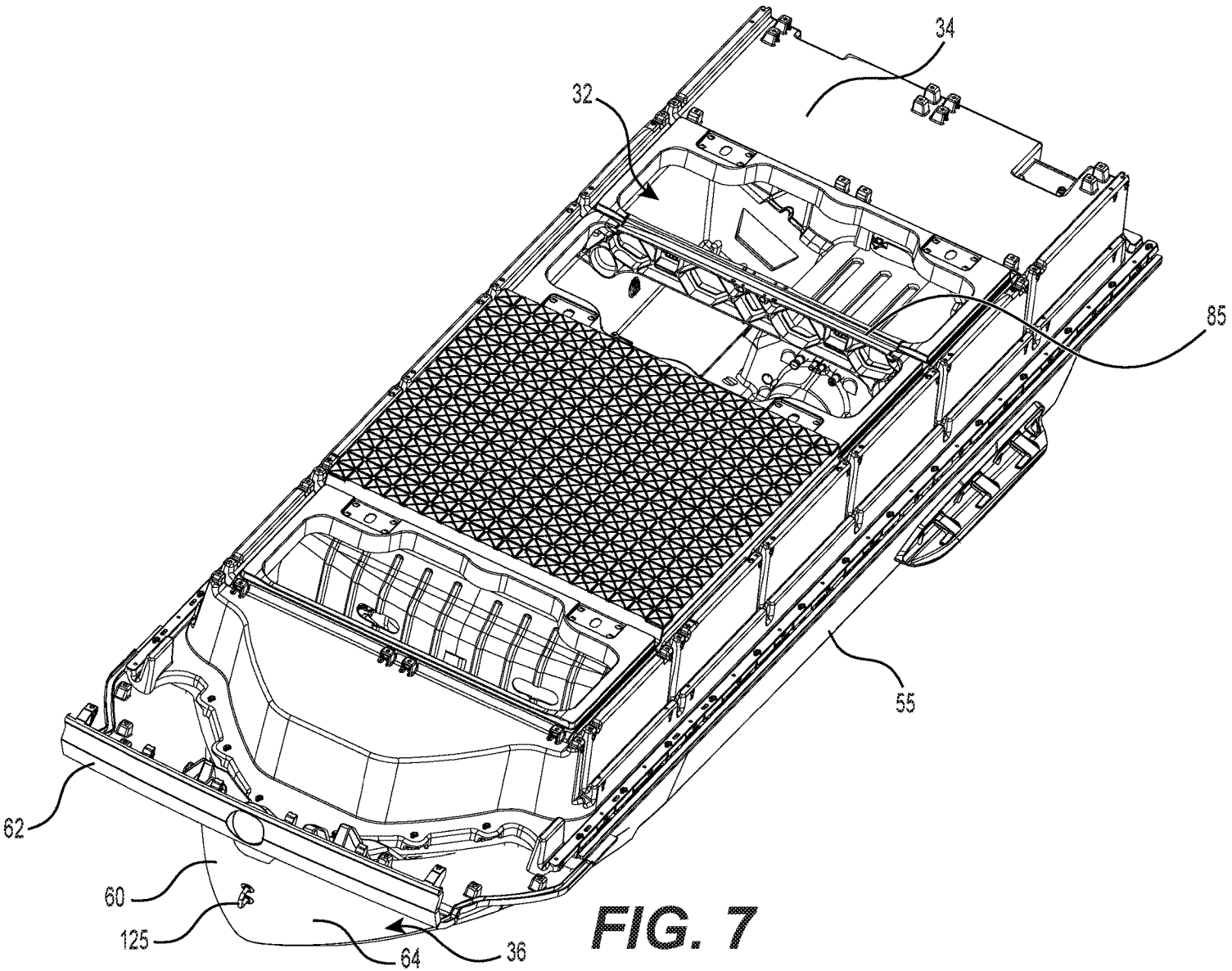
FIG. 7 is a perspective view, taken from a front left side, of a central hull and a rear hull cover of the pontoon boat of FIG. 1.

In this embodiment, the central hull 30 and the lateral hulls 40 of the boat 10 are constructed modularly so as to simplify the production and assembly of various length hulls based on common components. More specifically, the lateral hulls 40 of the boat 10 are assembled from a plurality of "modules", the number of which determines the length of each hull 40. A detailed description of the construction of the lateral hulls 40 is provided in U.S. Provisional Patent Application No. 62/908,514, filed on Sep. 30, 2019, the entirety of which is incorporated by reference herein. Notably, as shown in FIG. 6, each lateral hull 40, disposed on a lateral side of the central hull 30, includes a plurality of braces 101 and buoyant elements 105 to respectively provide rigidity and buoyancy to the lateral hull 40. A number of lateral hull panels 75 are assembled to form the exterior surface of the lateral hull 40.

It is contemplated that, in other embodiments, the lateral hulls 40 may not be constructed modularly but may instead each be an integral component.

The construction of the modular central hull 30 will now be described in greater detail. As mentioned above, the modular construction of the central hull 30 allows making the different sized boats 10, 10', 10" of the same family of boats by using common modular components for their assembly. As the boat 10 is a smallest one of the boats of the family of boats 10, 10', 10", the central hull 30 of the boat 10 includes only two modules that are attached to one another to form the central hull 30. In particular, the central hull 30 includes a rear hull module 32 and a front hull module 36 attached to the rear hull module 32.

Figure 12:
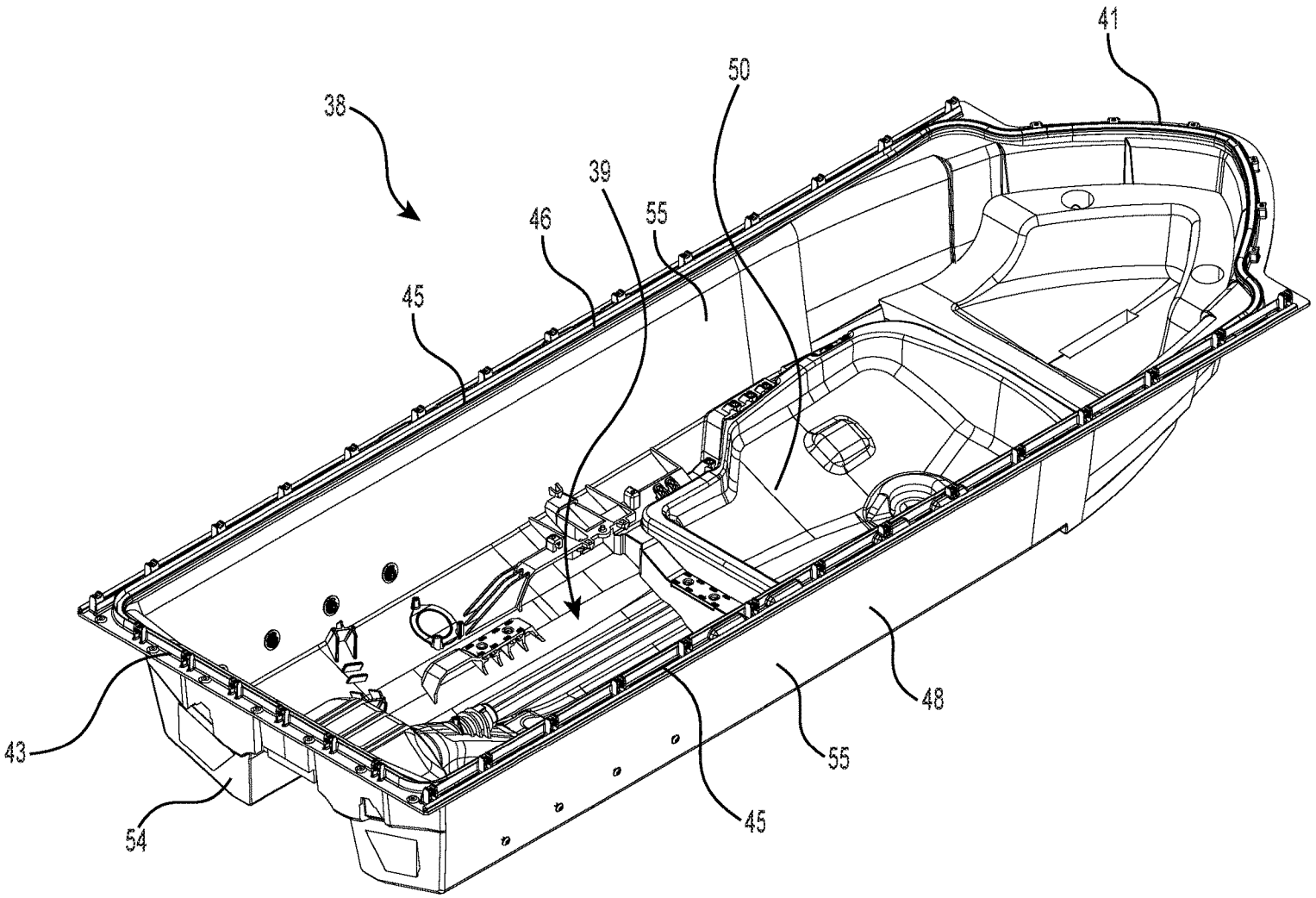
FIG. 12 is a perspective view, taken from a rear right side, of a rear hull panel of the central hull of FIG. 7.
Figure 13:
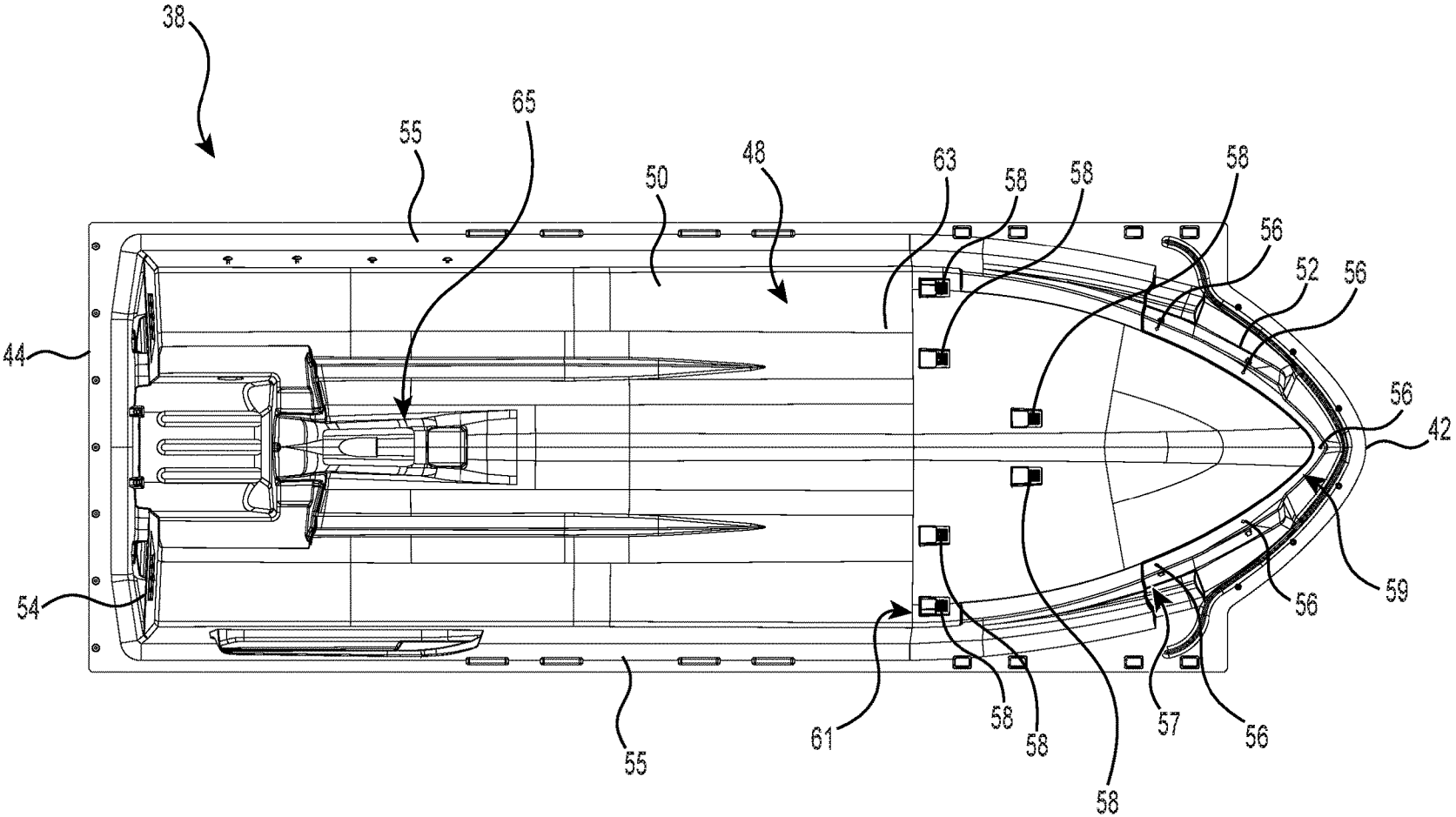
FIG. 13 is a bottom plan view of the rear hull panel of FIG. 12.
Figure 15:
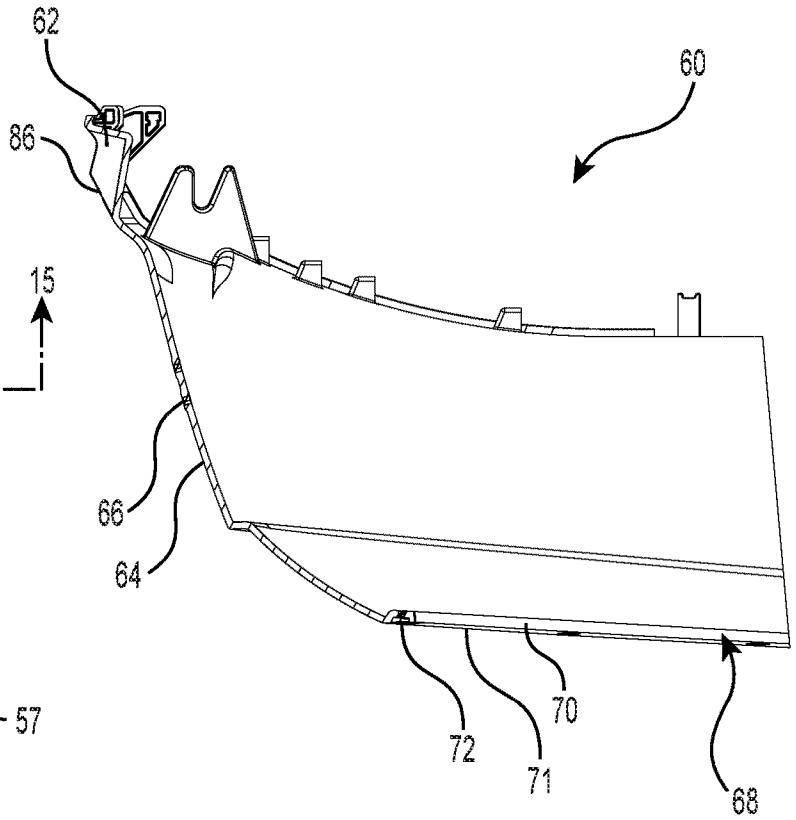
FIG. 15 is a cross-sectional view of the front hull panel of FIG. 14 taken along line 15-15 in FIG. 14.

As shown in FIGS. 12 and 13, the rear hull module 32 includes a rear hull panel 38 having a lower wall 50, a front wall 52, a rear wall 54, and two opposite lateral walls 55. The front wall 52, the rear wall 54 and the lateral walls 55 extend upwardly from the lower wall 50. The rear hull panel 38 is thus a convex member having an upper peripheral edge 46 which defines an open upper end of the rear hull panel 38. The rear hull panel 38 may thus also be thought of as a "rear hull shell" given its convex shape and surrounding walls. As shown in FIG. 12, the upper peripheral edge 46 has a front portion 41, a rear portion 43 and two opposite lateral portions 45. The rear portion 43 and the lateral portions 45 are rectilinear. However, the front portion 41 is generally V-shaped (with a tip thereof pointing forwardly). A length of the rear hull panel 38 is defined between a front end 42 of the rear hull panel 38, as defined by the front portion 41 of the upper peripheral edge 46, and a rear end 44 of the rear hull panel 38, as defined by the rear portion 43 of the upper peripheral edge 46.

As can be seen in FIG. 13, the lower wall 50 defines a lower surface 63 of the rear hull panel 38 which defines a plurality of openings 56 at a front portion 59 of the rear hull panel 38, near an intersection with the front surface 52. As can be seen, the openings 56 are arranged in a generally V-shaped attachment pattern 57. As will be described below, the openings 56 are used to attach the rear hull module 32 and the front hull module 36. As such, the openings 56 may also be referred to as "attachment features" of the rear hull panel 38.

Furthermore, with continued reference to FIG. 13, the lower surface 63 of the rear hull panel 38 also defines a plurality of openings 58 which are located at the front portion 59, rearwardly of the openings 56. As can be seen, the openings 58 are arranged in an attachment pattern 61 that is different from the attachment pattern 57 of the openings 56. Notably, the attachment pattern 61 is a stepped pattern having three segments, each segment including two of the openings 58 longitudinally aligned with one another and laterally spaced from one another. A central one of the three segments is located forward of the two other segments. The openings 58 are not used in the assembly of the boat 10. However, as will be described in greater detail below, the openings 58 are used for assembling the other boats 10', 10" of the family of boats. The openings 58 may thus also be referred to as "attachment features" of the rear hull panel 38.

As shown in FIG. 12, the rear hull panel 38 defines a power pack portion 39 configured to receive in part the power pack 50 of the boat 10. As can be seen in FIG. 13, the lower surface 63 of the rear hull panel 38 also defines an inlet aperture 65, covered in part by an inlet grate 69 (FIG. 4), for entry of water into a compartmentalized part of the power pack portion 39 from which a jet of water is discharged through the steering nozzle 53 for propulsion of the boat 10. As can be seen in FIG. 6, when the boat 10 is assembled, a rear hull cover 34 (FIG. 6) overlies the power pack 50 to partly enclose the power pack 50 between the central hull 30 and the rear hull cover 34.

With continued reference to FIG. 6, two vertical wall members 77 are provided on either lateral side of the central hull 30. The vertical wall members 77 are connected to the rear hull cover 34. A rear one of the vertical wall members 77 extends rearwardly from the rear hull cover 34 while a front one of the vertical wall members 77 extends forwardly from the rear hull cover 34. The vertical wall members 77 support the tiles 22 of the deck 20 that extend thereabove. Laterally-extending braces 85 connect opposite lateral sides of the rear hull cover 34.

Figure 5:
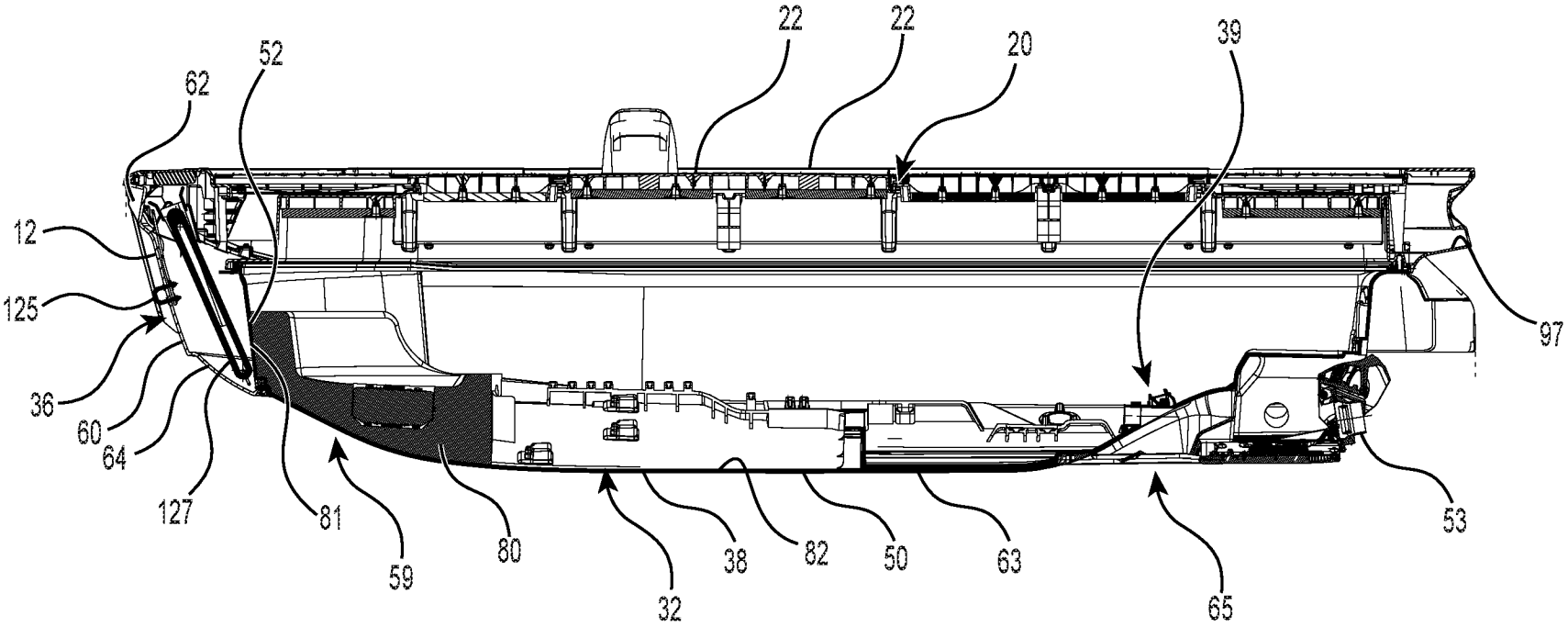
FIG. 5 is a cross-sectional view of the pontoon boat of FIG. 1 taken along line 5-5 in FIG. 3.

As shown in FIG. 5, the rear hull module 32 also includes a buoyant element 80 disposed atop part of the rear hull panel 38. More specifically, the buoyant element 80 is disposed at the front portion 59 of the rear hull panel 38, in contact with the front wall 52 and the lower wall 50. In this embodiment, the buoyant element 80 is made of a closed-cell foam material and may thus be referred to as a "foam block". It is contemplated that the buoyant element 80 could be made of any other suitable foam material in other embodiments. However, it is contemplated that the buoyant element 80 could consist of other types of buoyant elements in other embodiments (e.g., an inflatable bag, a plastic container, etc.). As shown in FIG. 5, the foam buoyant element 80 is shaped and sized to conform to part of a front inner surface 81 of the rear hull panel 38 defined by the front wall 52 and to part of a lower inner surface 82 of the rear hull panel 38 defined by the lower wall 50.

It is contemplated that additional buoyant elements may be provided within the walls of the rear hull panel 38.

A rear bumper 97 (FIGS. 1, 3 and 4) is connected to the rear end 44 of the rear hull panel 38 and extends rearwardly therefrom.

Figure 4:
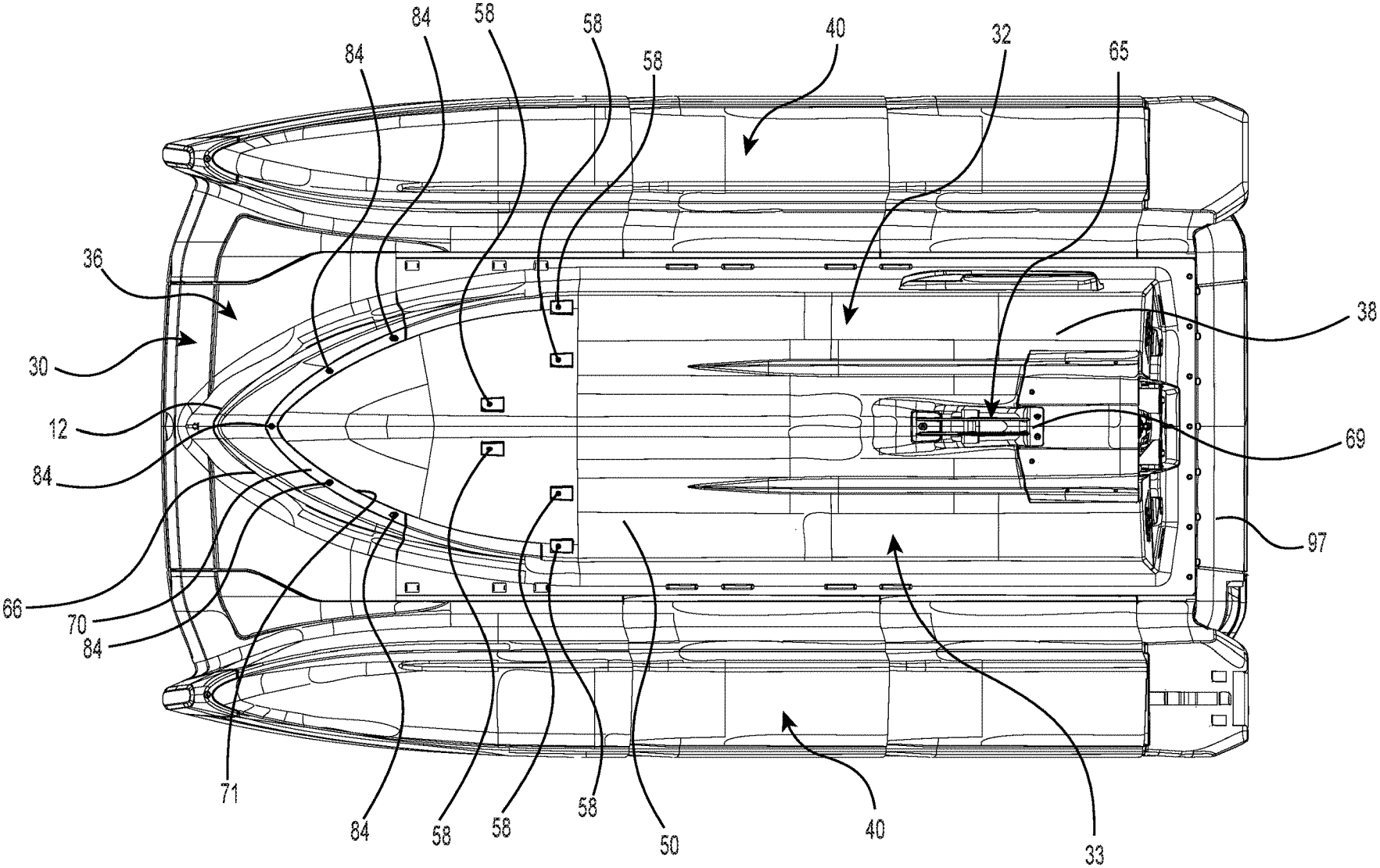
FIG. 4 is a bottom plan view of the pontoon boat of FIG. 1.

As shown in FIG. 5, the front hull module 36 includes a front hull panel 60 which defines a bow 12 of the boat 10. The front hull panel 60 has an upper portion 62 and a lower portion 64 extending below the upper portion 64. As can be seen in FIG. 3, the upper portion 62 of the front hull panel 60 defines part of a front upper periphery of the boat 10. The lower portion 64 of the front hull panel 60 is configured to deflect water toward either side thereof as the boat 10 moves forwardly. To that end, as shown in FIG. 4, the lower portion 64 has a generally V-shaped front outer surface 66.

Figure 14:
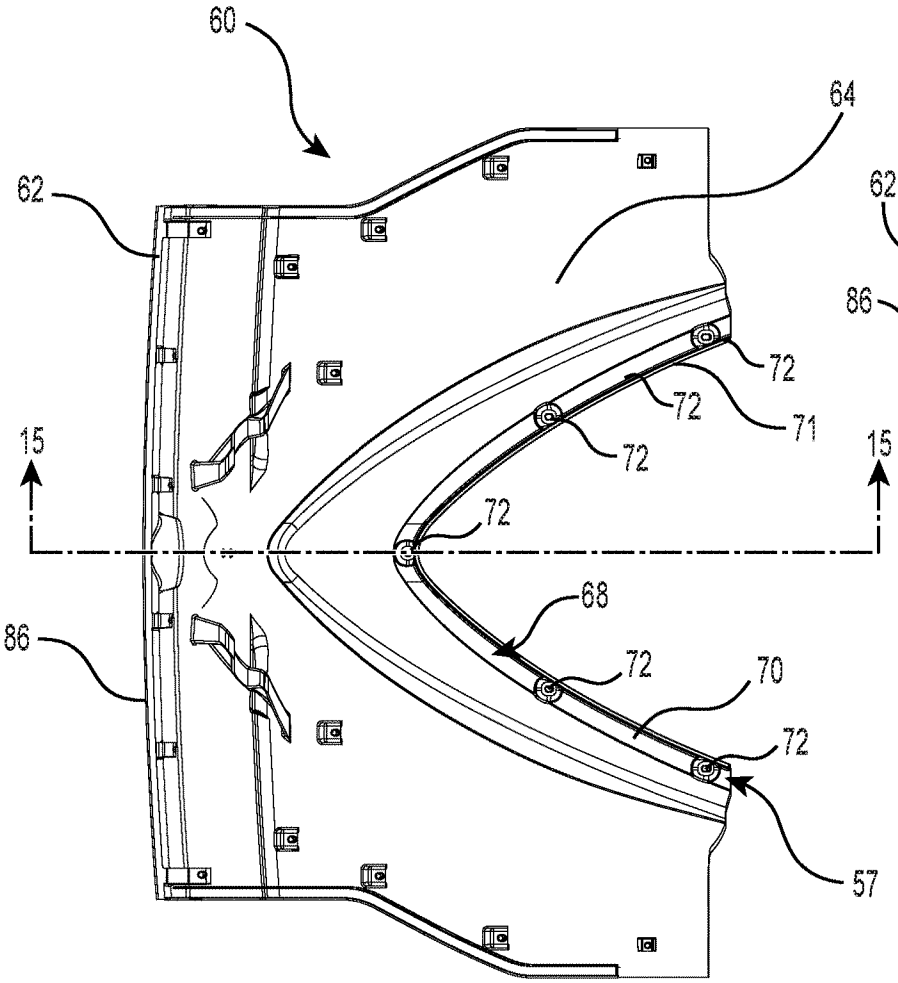
FIG. 14 is a top plan view of a front hull panel of the central hull of FIG. 7.

With reference to FIG. 14, a rear portion 68 of the front hull panel 60 defines a lower lip 70 forming the lower end of the front hull panel 60. The lower lip 70 has a V-shaped peripheral edge 71 and defines a plurality of openings 72 which are used for connecting the front hull panel 60 to the rear hull panel 38. The openings 72 may thus be referred to as "attachment features" of the front hull panel 60. As can be seen in FIG. 14, the openings 72 are arranged in the same generally triangular attachment pattern 57 as the openings 56 of the rear hull panel 38 so that they can be aligned with one another during assembly of the boat 10.

Figure 2:
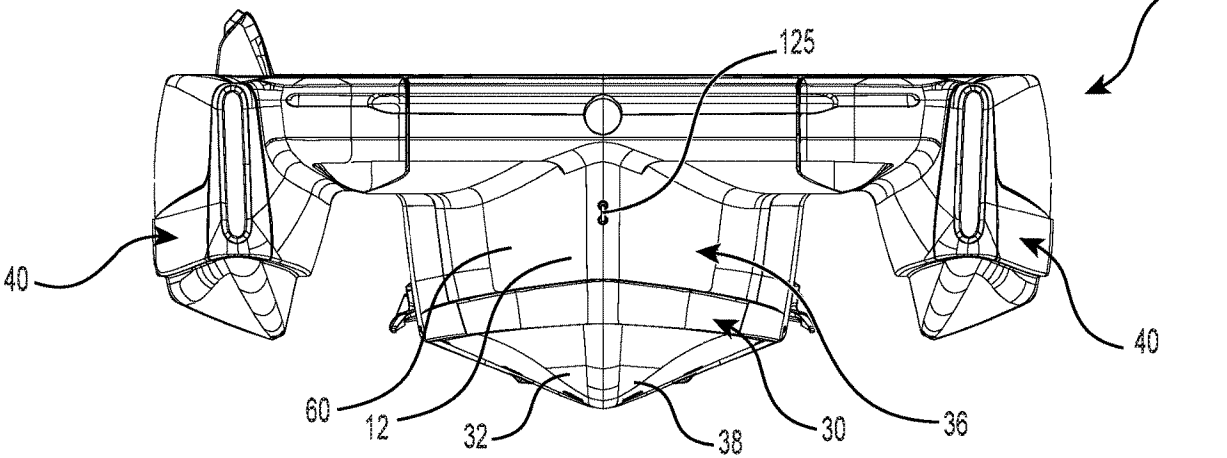
FIG. 2 is a front elevation view of the pontoon boat of FIG. 1.

As can be seen in FIG. 2, a tow eye 125 protrudes forwardly from the front hull panel 60. Moreover, as shown in FIG. 5, an anchor housing 127 is disposed between the front hull panel 60 and the rear hull panel 38.

The method of assembly of the central hull 30 of the boat 10 thus involves the rear and front hull modules 32, 36. Notably, when assembling the boat 10, the front hull panel 60 is attached to the rear hull panel 38 such that the front hull panel 60 extends forwardly of the rear hull panel 38. In particular, the rear portion 68 of the front hull panel 60 is positioned below the front portion 59 of the rear hull panel 38, and the openings 72 of the front hull panel 60 are aligned with the openings 56 of the rear hull panel 38 (as they have the same attachment pattern 57). Fasteners 84 are then inserted into the openings 56, 72 to secure the front hull panel 60 to the rear hull panel 38. In the present embodiment, the fasteners 84 comprise bolts and nuts, although other types of fasteners are contemplated, such as screws or clips. In an alternate embodiment, one of the front hull panel 60 and the rear hull panel 38 includes clips formed therein and arranged in the attachment pattern 57, while the other of the front hull panel 60 and the rear hull panel 38 includes corresponding clip-receiving structures, such as an opening, similarly arranged in the attachment pattern 57 and sized and shaped to receive and retain the clips.

Figure 8:
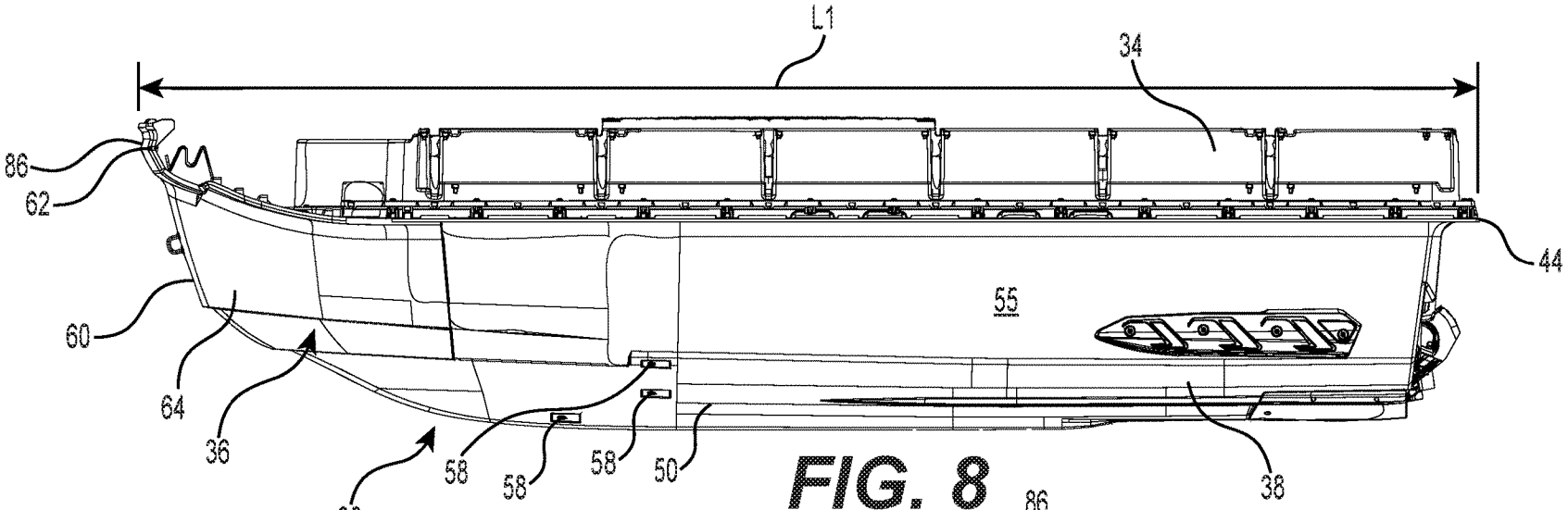
FIG. 8 is a left side elevation view of the central hull of FIG. 7.
Figure 9:
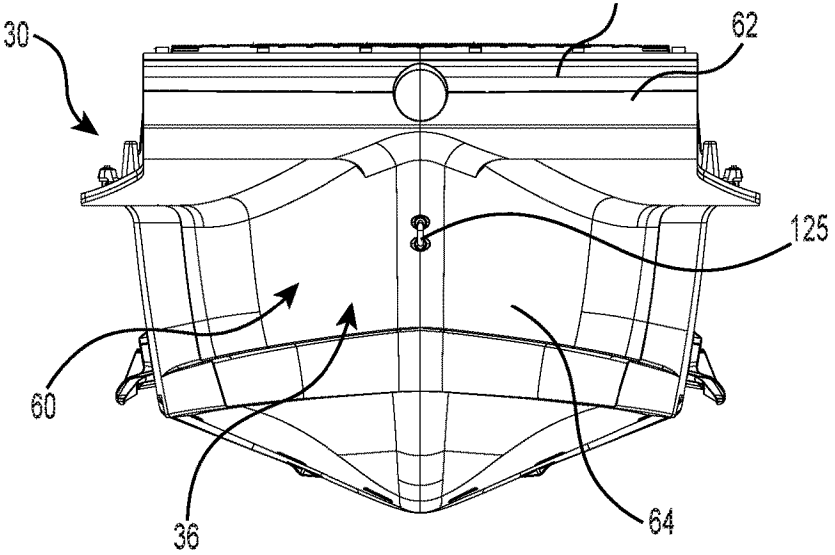
FIG. 9 is a front elevation view of the central hull of FIG. 7.
Figure 10:
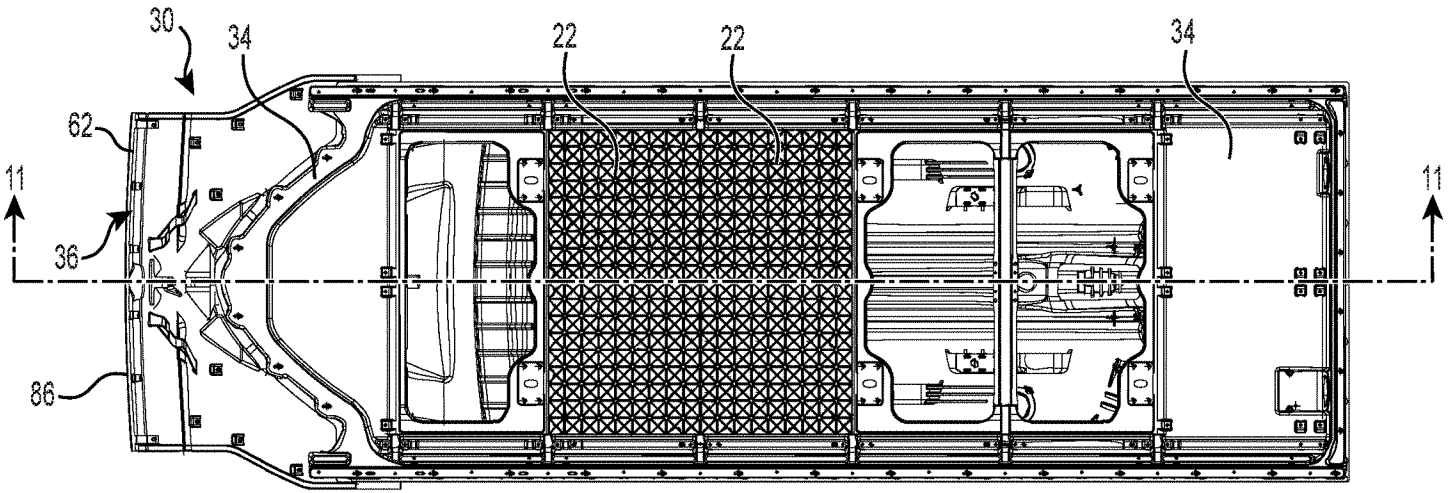
FIG. 10 is a top plan view of the central hull of FIG. 7.
Figure 11:
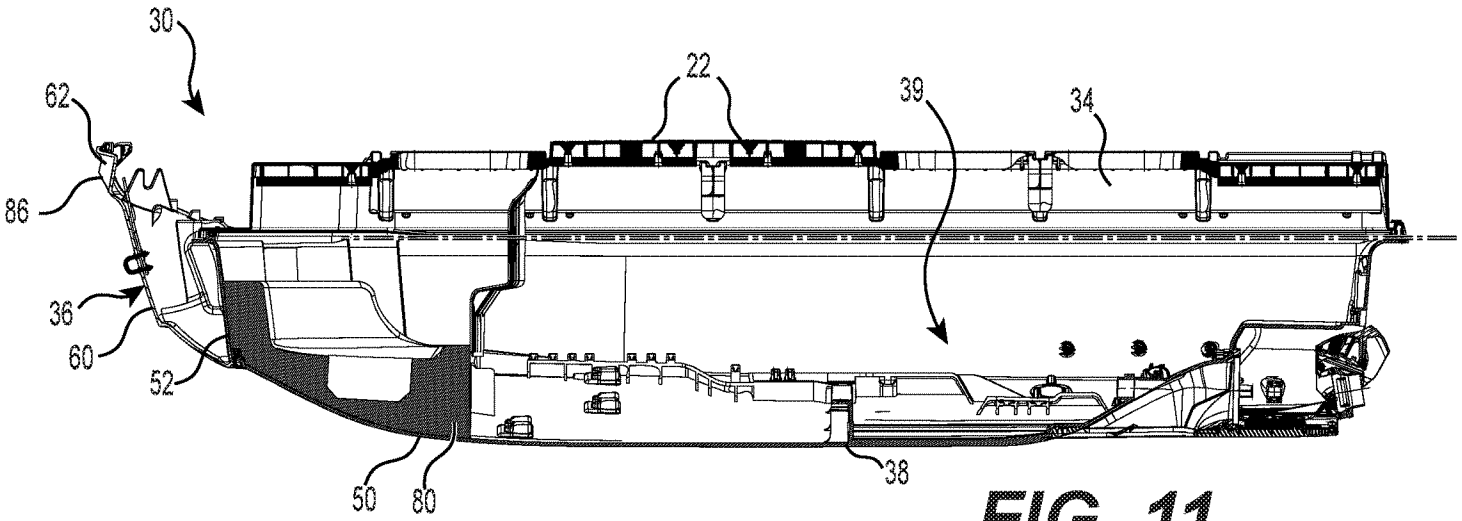
FIG. 11 is a cross-sectional view of the central hull of FIG. 7 taken along line 11-11 in FIG. 10.

Thus, in the context of the boat 10, the front hull panel 60 and the rear hull panel 38 together form the central hull 30 and define a substantially continuous running surface 33 of the boat 10. As shown in FIG. 8, a length L1 of the central hull 30 of the boat 10 is therefore defined between a front end 86 of the front hull panel 60 and the rear end 44 of the rear hull panel 38. Furthermore, when assembling the boat 10, the deck 20 is installed on the central hull 30 such that it extends over the front hull module 36 and the rear hull module 32. The front hull panel 60 and the rear hull panel 38 are not sealed to one another below the water line of the boat 10 (i.e., the line where the hull 30 meets the surface of the water when the boat 10 is at rest on level water) and, as such, water can enter the space between the front hull panel 60 and the rear hull panel 38 via the joint therebetween, in particular when the boat 10 is at rest. It is contemplated that the front and rear hull panels 60, 38 could be sealingly fixed to one another below the water line.

The boat 10' of the family of boats will now be described with reference to FIGS. 16 to 18. As can be seen, the boat 10' includes the same rear hull module 32 and the same front hull module 36 as the boat 10 described above. However, the boat 10' has a greater length than the boat 10, namely through the inclusion of a buoyant hull extension module 90 which is attached to the rear and front hull modules 32, 36. The hull extension module 90 includes a hull extension panel 92 which is attached between the front hull panel 60 and the rear hull panel 38.

Figure 16:
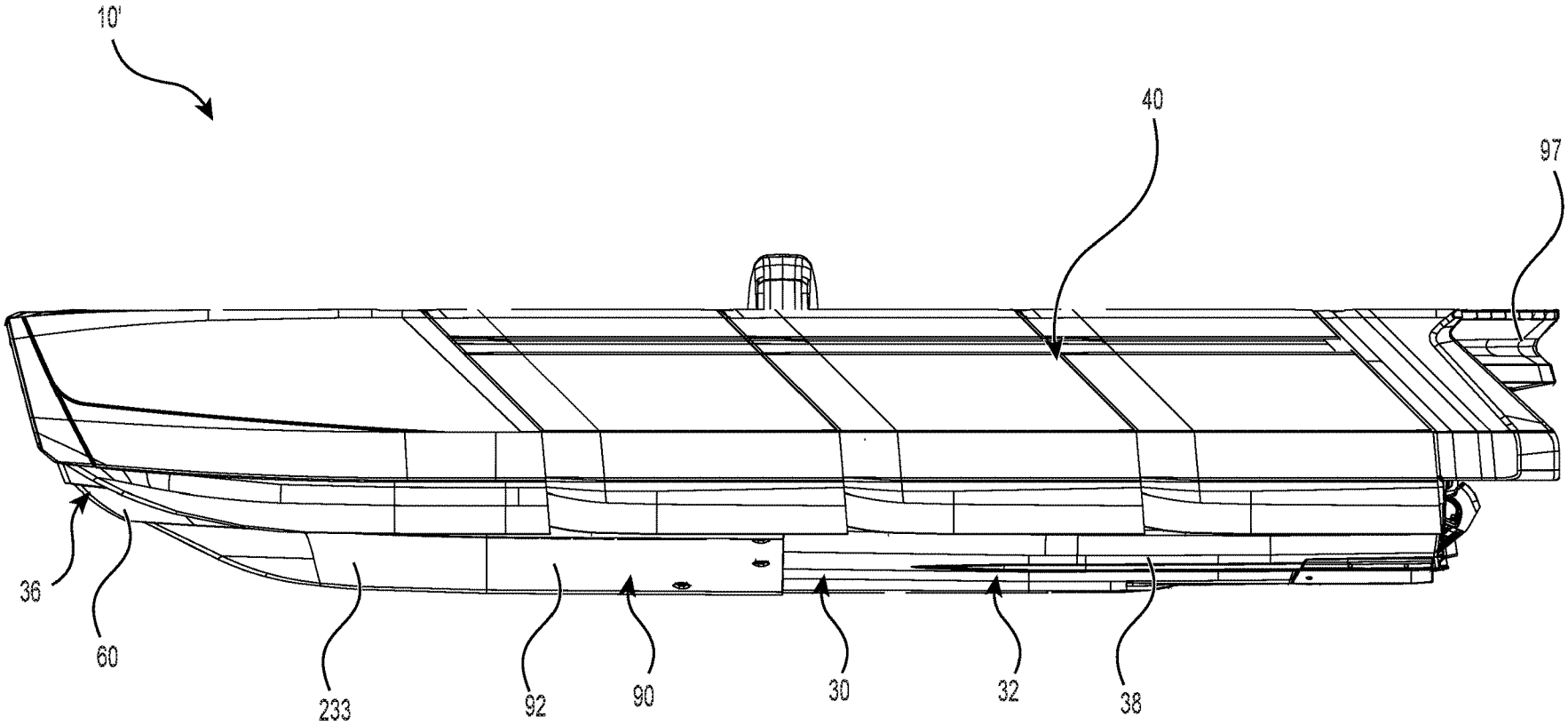
FIG. 16 is a left side elevation view of another pontoon boat of the family of pontoon boats.
Figure 17:
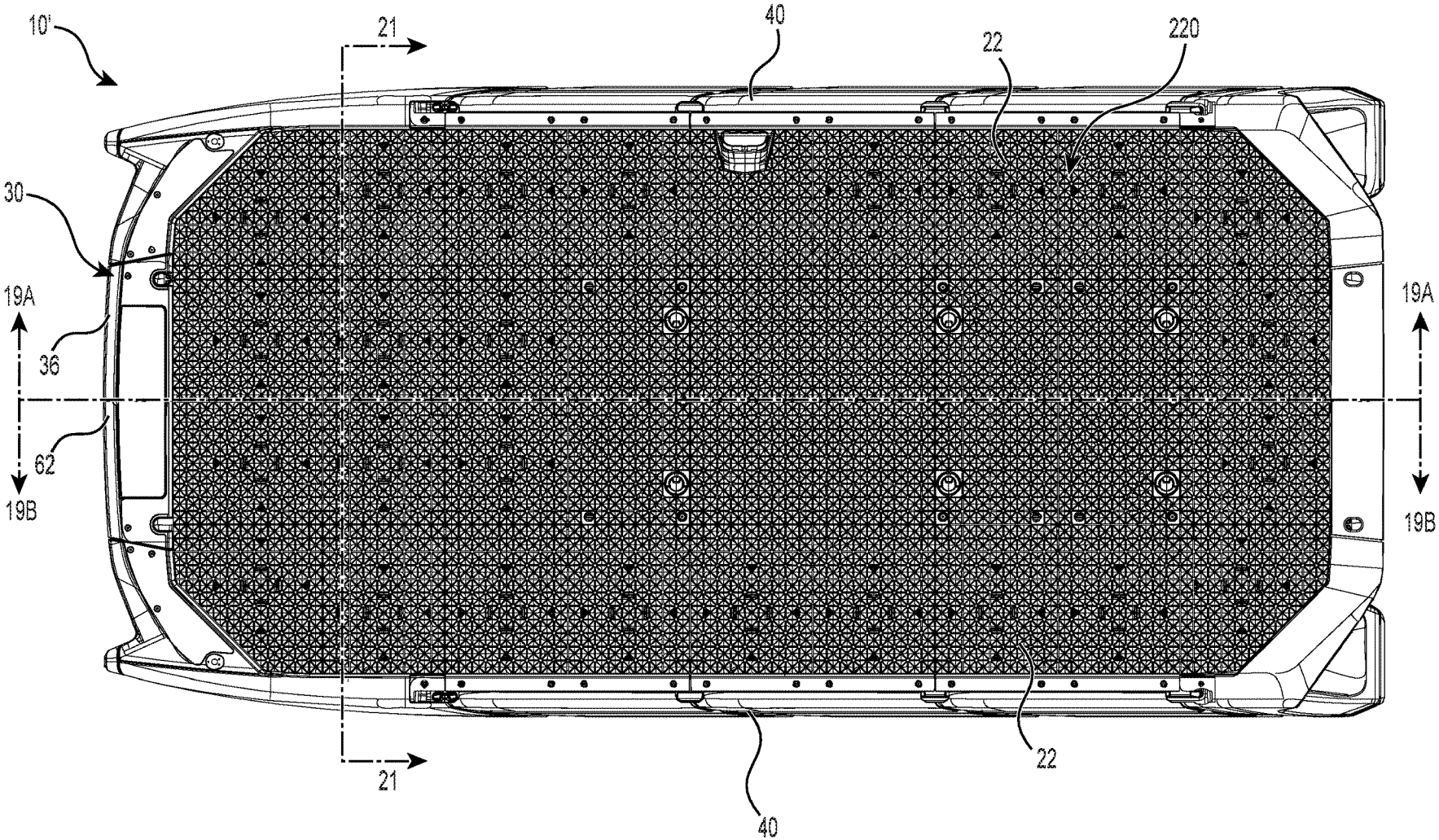
FIG. 17 is a top plan view of the pontoon boat of FIG. 16.
Figure 18:
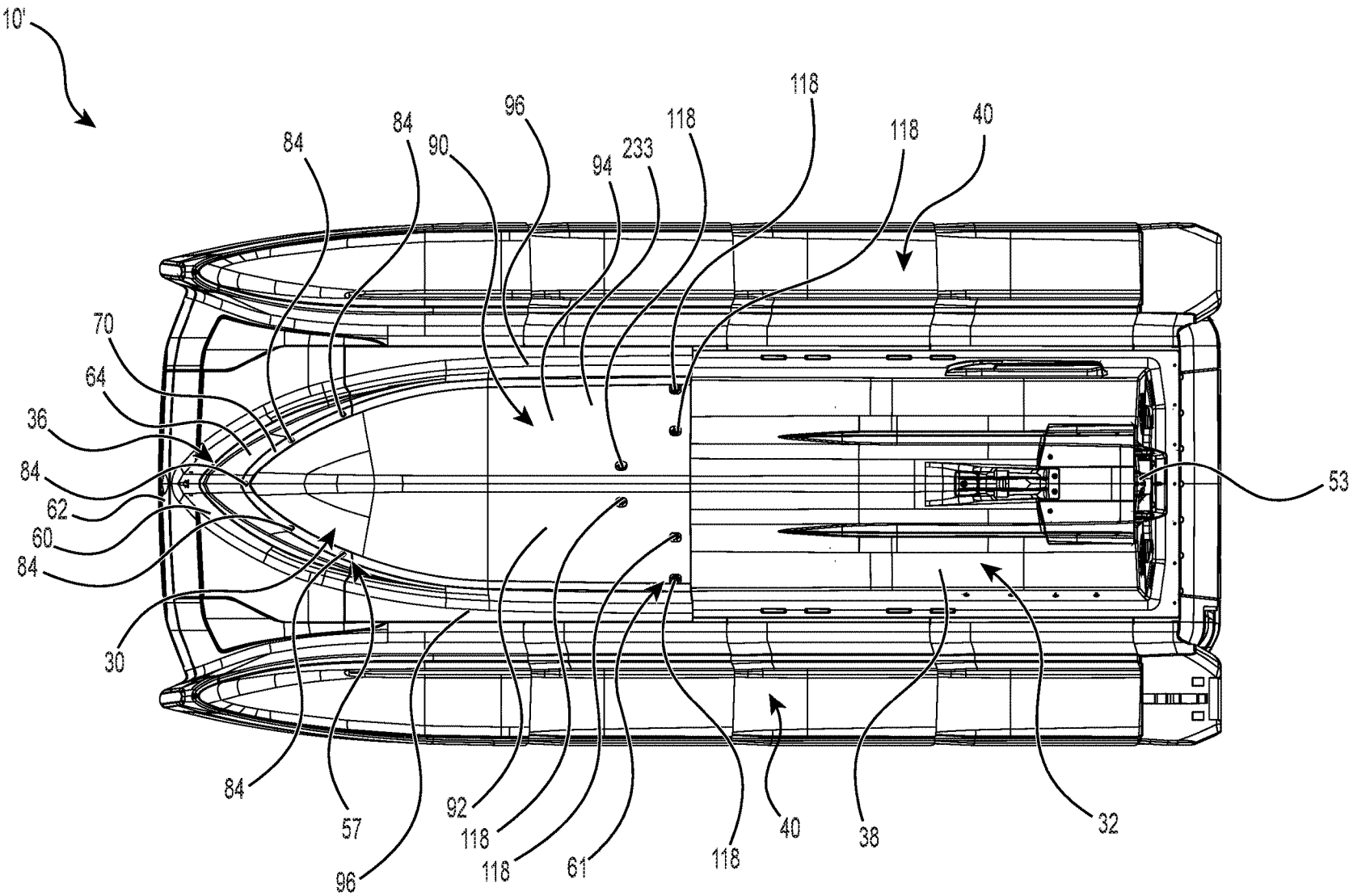
FIG. 18 is a bottom plan view of the pontoon boat of FIG. 16.
Figure 20:
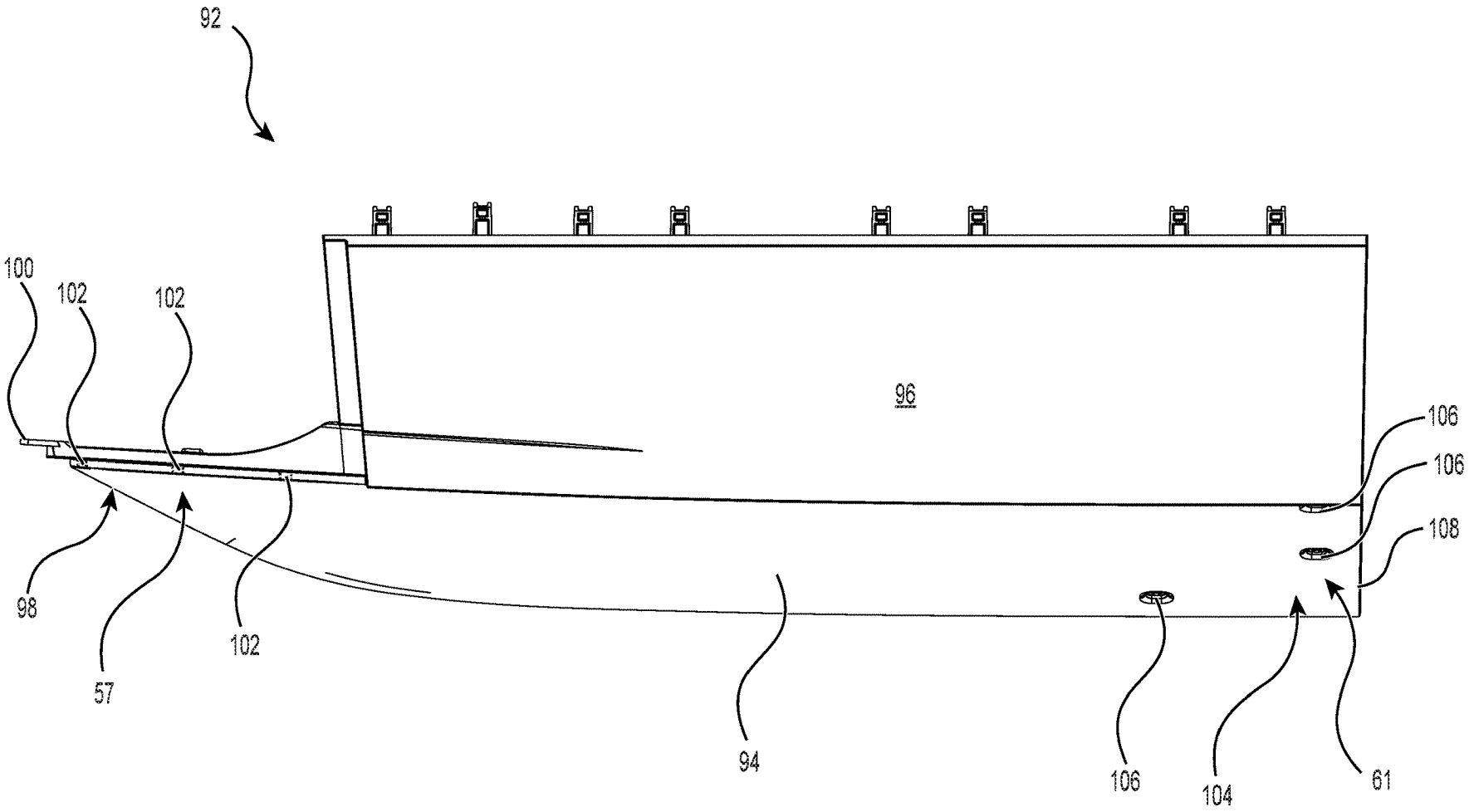
FIG. 20 is left side elevation view of a hull extension panel of a hull extension module of the pontoon boat of FIG. 16.
Figure 21:
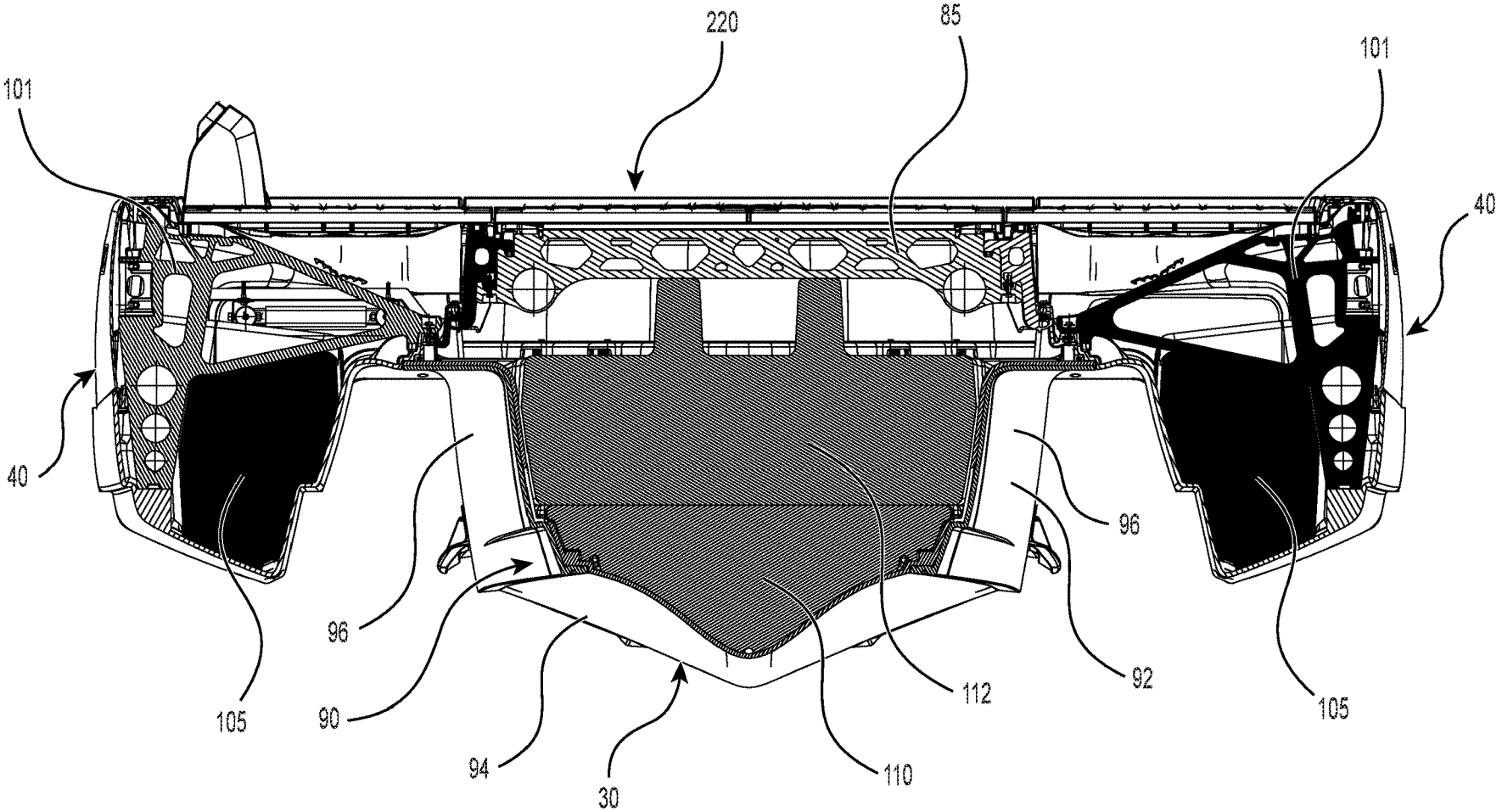
FIG. 21 is a cross-sectional view of the pontoon boat of FIG. 16 taken along line 21-21 in FIG. 17.
Figure 22:
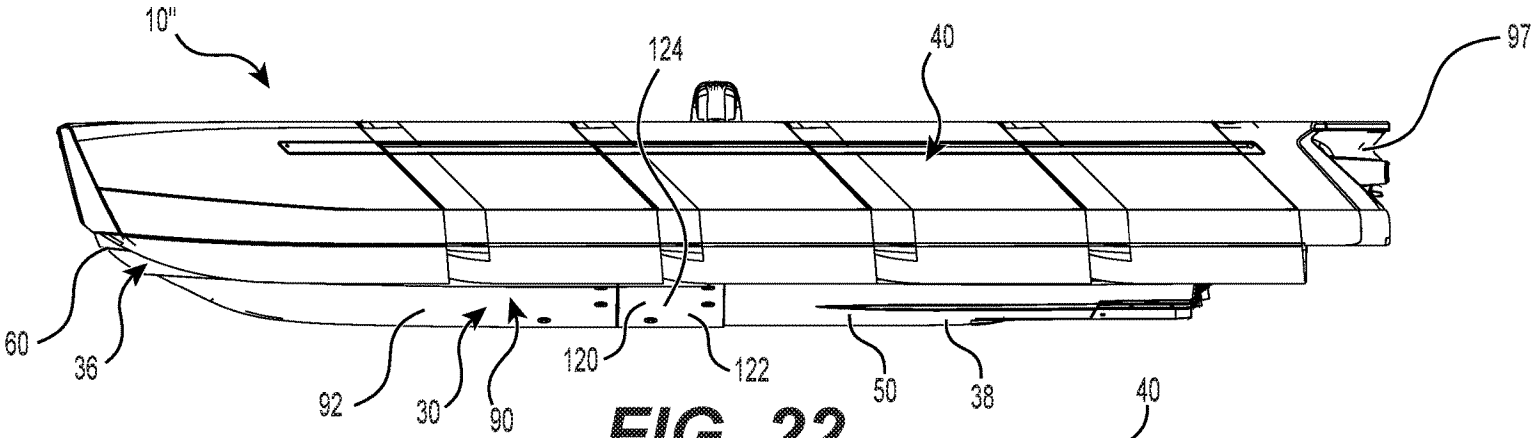
FIG. 22 is left side elevation view of another pontoon boat of the family of pontoon boats.
Figure 23:
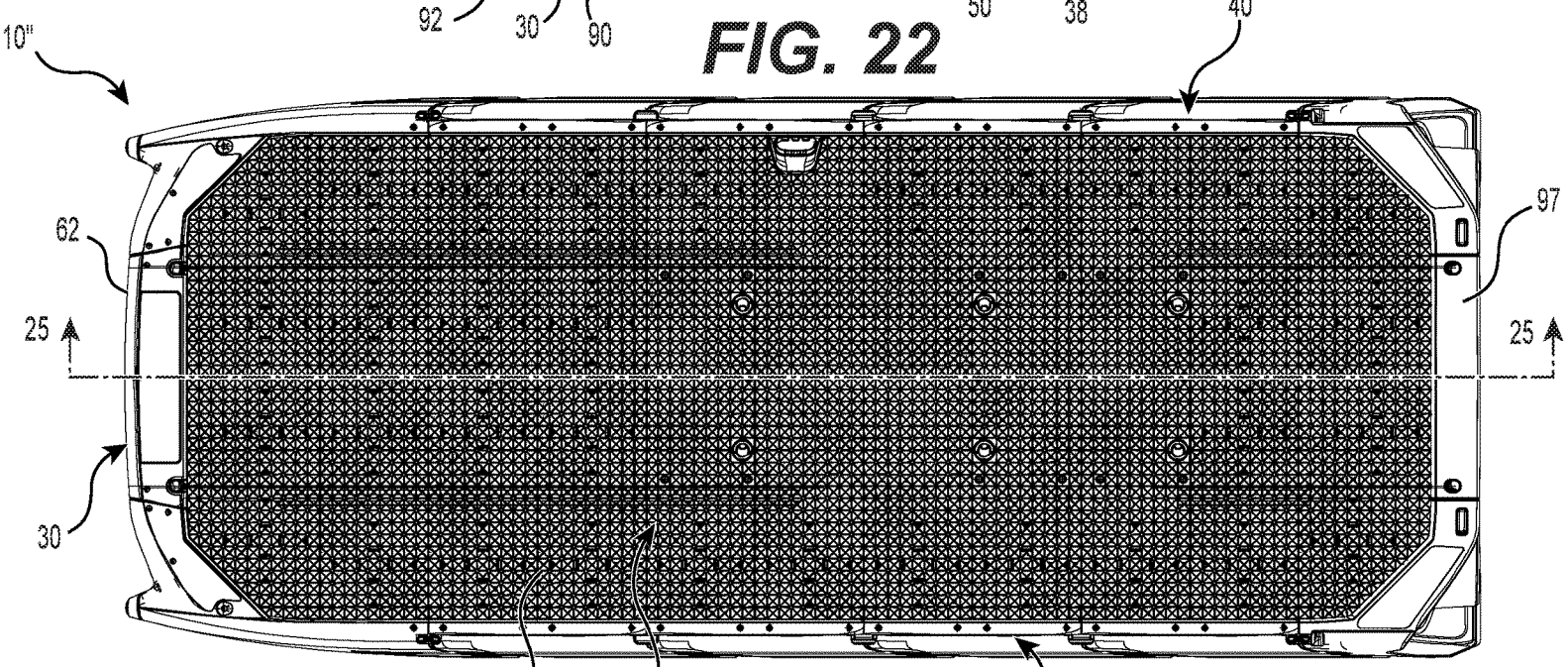
FIG. 23 is a top plan view of the pontoon boat of FIG. 22.

With reference to FIGS. 16, 18 and 20, the hull extension panel 92 has a bottom wall 94 and two opposite lateral walls 96 (only one of which is shown in FIG. 20) extending upwardly from the bottom wall 94. The walls 94, 96 thus form a U-shape of the hull extension panel 92. A front portion 98 of the hull extension panel 92, which in this embodiment extends forwardly from the lateral walls 96, is generally V-shaped so that a tip of the V-shaped front portion 98 (i.e., the front end 100 of the hull extension panel 92) points forwardly.

The hull extension panel 92 is configured to be attached to both the front hull panel 60 and the rear hull panel 38. Notably, as shown in FIG. 20, the front portion 98 defines a plurality of openings 102 (only three of which are shown in FIG. 20) disposed near the front end 100 and arranged in the same attachment pattern 57 as the openings 72 of the front hull panel 60. As will be described below, the openings 102 are used for connecting the hull extension panel 92 to the front hull panel 60. As such, the openings 102 may be referred to as "attachment features" of the hull extension panel 92. Meanwhile, a rear portion 104 of the hull extension panel 92 defines a plurality of openings 106 disposed near a rear end 108 of the hull extension panel 92 and arranged in the same attachment pattern 61 as the openings 58 of the rear hull panel 38. As will be described below, the openings 106 are used for connecting the hull extension panel 92 to the rear hull panel 38. As such, the openings 106 may also be referred to as "attachment features" of the hull extension panel 92.

With reference to FIGS. 19A and 19B, the hull extension module 90 is made buoyant by two buoyant elements 110, 112. In particular, in this embodiment, the buoyant element 110 is positioned atop the hull extension panel 92 and, in turn, the buoyant element 112 is positioned atop the buoyant element 110. In order to ensure proper stacking of the buoyant elements 110, 112, an upper surface 115 of the buoyant element 110 and a lower surface 117 of the buoyant element 112 have corresponding shapes. Furthermore, a rear surface 114 of the buoyant element 110 and a front outer surface 83 of the rear hull panel 38 (defined by the front wall 52) have corresponding shapes so that the buoyant element 110 and the rear hull panel 38 are closely fitted with one another. For similar reasons, a rear surface 116 of the buoyant element 112 and the front outer surface 83 of the rear hull panel 38 have corresponding shapes.

It is to be understood that surfaces having "corresponding shapes" entails that they fit together although they do not necessarily have to mate perfectly with one another. Moreover, a curved surface having a corresponding shape to another surface will be a convex or concave matching surface thereof (albeit they need to mate perfectly as mentioned above). More specifically, where a first surface is convex, a second surface having a corresponding shape thereto will be concave. Likewise, where the first surface is concave, the second surface having a corresponding shape thereto will be convex. For instance, each of the rear surfaces 114, 116 of the buoyant elements 110, 112 (which are generally concave surfaces) has a corresponding shape to part of the front outer surface 83 of the rear hull panel 38 because a lower part of the front outer surface 83 is a convex match of the concave rear surface 114 and an upper part of the front outer surface 83 is a convex match of the concave rear surface 116.

It is contemplated that, in other embodiments, the two buoyant elements 110, 112 could be replaced by a single buoyant element having their combined shape.

The buoyant elements 110, 112 are constructed of a same or similar material as the buoyant element 80 of the rear hull module 32. The buoyant elements 110, 112 could also be made of alternative materials as described above with respect to the buoyant element 80. It is also contemplated that, in other embodiments, the hull extension panel 92 and the buoyant element(s) could be formed by a single component, such as a hollow structure defining a hollow interior, that both forms the lower surface of the hull extension module 90 and provides buoyancy. Such an element could, for example, be a rotomolded component or a closed-cell foam with suitably strong outer skin.

The method of assembly of the central hull 30 of the boat 10' thus involves the rear hull module 32, the front hull module 36 and the hull extension module 90. Notably, when assembling the boat 10', the hull extension panel 92 is attached to the rear hull panel 38 such that the hull extension panel 92 extends forwardly of the rear hull panel 38, and the front hull panel 60 is attached to the hull extension panel 92 such that the front hull panel 60 extends forwardly of the hull extension panel 92. In particular, the rear portion 104 of the hull extension panel 92 is positioned below the portion of the rear hull panel 38 that defines the openings 58, and the openings 106 of the hull extension panel 92 are aligned with the openings 58 of the rear hull panel 38. As shown in FIG. 18, fasteners 118 are then inserted into the openings 58, 106 to secure the hull extension panel 92 to the rear hull panel 38. In the present embodiment, the fasteners 118 comprise screws which threadedly engage the openings 58 of the rear hull panel 38, although other types of fasteners are contemplated, such as bolts and nuts or clips. For instance, in an alternate embodiment, one of the hull extension panel 92 and the rear hull panel 38 includes clips formed therein and arranged in the attachment pattern 61, while the other of the hull extension panel 92 and the rear hull panel 38 includes corresponding clip-receiving structures, such as an opening, similarly arranged in the attachment pattern 61 and sized and shaped to receive and retain the clips. Next, the rear portion 68 of the front hull panel 60 is positioned below the front portion 98 of the hull extension panel 92, and the openings 72 of the front hull panel 60 are aligned with the openings 102 of the hull extension panel 92. As shown in FIG. 18, the fasteners 84 are then inserted into the openings 72, 102 to secure the front hull panel 60 to the hull extension panel 92. As mentioned above, the fasteners 84 could be other than bolts and nuts. For instance, in some embodiments, the one of the front hull panel 60 and the hull extension panel 92 includes clips formed therein and arranged in the attachment pattern 57, while the other of the front hull panel 60 and the hull extension panel 92 includes corresponding clip-receiving structures, such as an opening, similarly arranged in the attachment pattern 57 and sized and shaped to receive and retain the clips.

Thus, in the context of the boat 10', the front hull panel 60, the rear hull panel 38 and the hull extension panel 92 together form the central hull 30 and define a substantially continuous running surface 233 of the boat 10'. As shown in FIG. 19A, a length L2 of the central hull 30 of the boat 10' is therefore defined between the front end 86 of the front hull panel 60 and the rear end 44 of the rear hull panel 38. The length L2 of the boat 10' is greater than the length L1 of the boat 10. In this embodiment, the hull extension panel 92 is not sealed to the front hull panel 60 and the rear hull panel 38 below the water line of the boat 10' (i.e., the line where the hull 30 meets the surface of the water when the boat 10' is at rest on level water) and, as such, water can enter the space between the hull extension panel 92 and the front hull panel 60, and/or between the hull extension panel 92 and the rear hull panel 38 via the joints therebetween, in particular when the boat 10' is at rest. However, because the space below the water line between the front hull panel 60, the hull extension panel 92, the rear hull panel 38 and the deck 20 is almost entirely filled with the buoyant elements 110, 112, the non-sealed nature of those joints does not affect flotation of the central hull 30. It is contemplated that the hull extension panel 92 could be sealingly fixed to the front and rear hull panels 60, 38 below the water line.

Given the greater length of the boat 10' compared to the boat 10, a longer deck is installed on the boat 10' than on the boat 10. Notably, a deck 220 is installed on the central hull 30 such that it extends over the front hull module 36, the hull extension module 90 and the rear hull module 32. The deck 220 includes the same components as the deck 20 but has additional tiles 22 to cover the added length of the boat 10'. The hull extension module 90, and more particularly the buoyant elements 110, 112 of the present embodiment, provide buoyancy to support the additional deck area that extends thereabove.

The boat 10" of the family of boats will now be described with reference to FIGS. 22 to 25. As can be seen, the boat 10" includes the same rear hull module 32, the same front hull module 36, and the same hull extension module 90 as the boat 10' described above.

However, the boat 10" has a greater length than the boat 10', namely through the inclusion of an additional buoyant hull extension module 120 which is attached to the rear hull module 32 and the hull extension module 90. The additional hull extension module 120 includes an additional hull extension panel 122 which is attached between the hull extension panel 92 and the rear hull panel 38.

Figure 25:
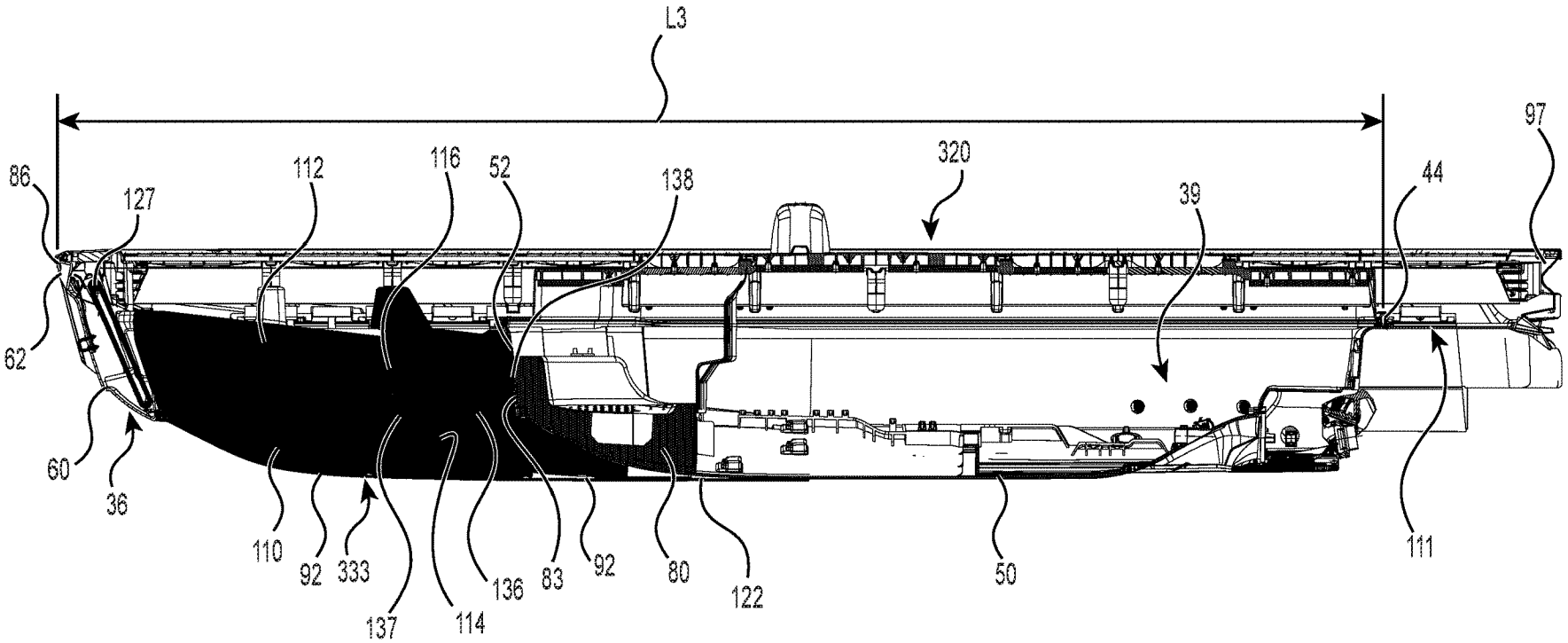
FIG. 25 is a cross-sectional view of the pontoon boat of FIG. 22 taken along line 25-25 in FIG. 23.
Figure 26:
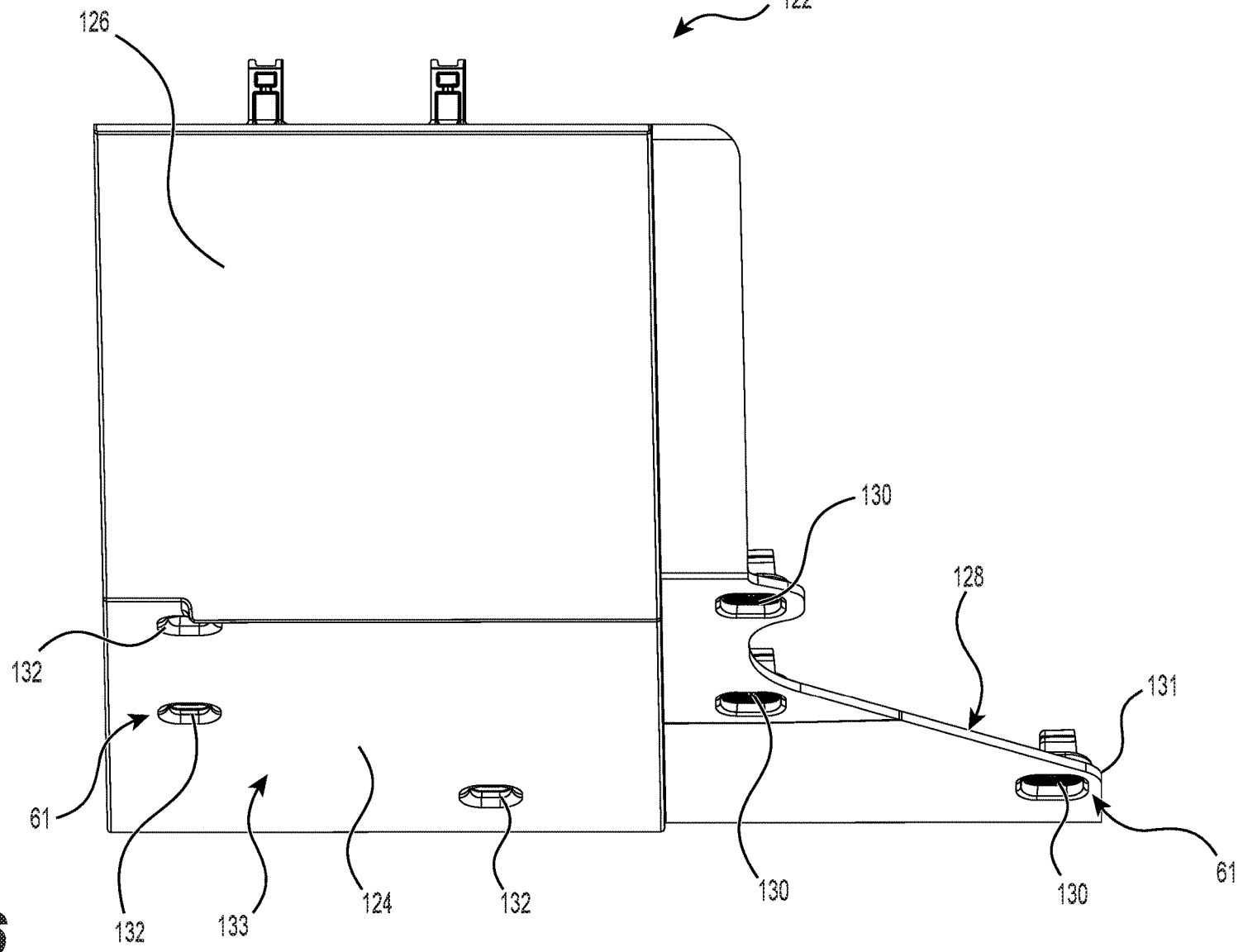
FIG. 26 is a right side elevation view of an additional hull extension panel of an additional hull extension module of the pontoon boat of FIG. 22.

With reference to FIG. 26, the additional hull extension panel 122 has a bottom wall 124 and two opposite lateral walls 126 (only one of which is shown in FIG. 25) extending upwardly from the bottom wall 124. The walls 124, 126 thus form a U-shape of the additional hull extension panel 122. A front portion 128 of the additional hull extension panel 122, which in this embodiment extends forwardly from the lateral walls 126, is generally V-shaped so that a tip of the V-shaped front portion 128 (i.e., the front end 131 of the additional hull extension panel 122) points forwardly.

The additional hull extension panel 122 is configured to be attached to both the hull extension panel 92 and the rear hull panel 38. Notably, as shown in FIG. 26, the front portion 128 defines a plurality of openings 130 (only three of which are shown in FIG. 26) disposed near the front end 131 and arranged in the same attachment pattern 61 as the openings 106 of the hull extension panel 92. As will be described below, the openings 130 are used for connecting the additional hull extension panel 122 to the hull extension panel 90. As such, the openings 130 may be referred to as "attachment features" of the additional hull extension panel 122. Meanwhile, the lower wall 124 of the additional hull extension panel 122 defines a plurality of openings 132 (only three of which are shown in FIG. 26) at a rear portion 133 of the additional hull extension panel 122, disposed rearwardly of the openings 130 and arranged in the same attachment pattern 61 as the openings 58 of the rear hull panel 38. As will be described below, the openings 132 are used for connecting the additional hull extension panel 122 to the rear hull panel 38. As such, the openings 132 may also be referred to as "attachment features" of the additional hull extension panel 122. The openings 130, 132 of the additional hull extension panel 122 are thus arranged in the same stepped attachment pattern 61.

Figure 27:
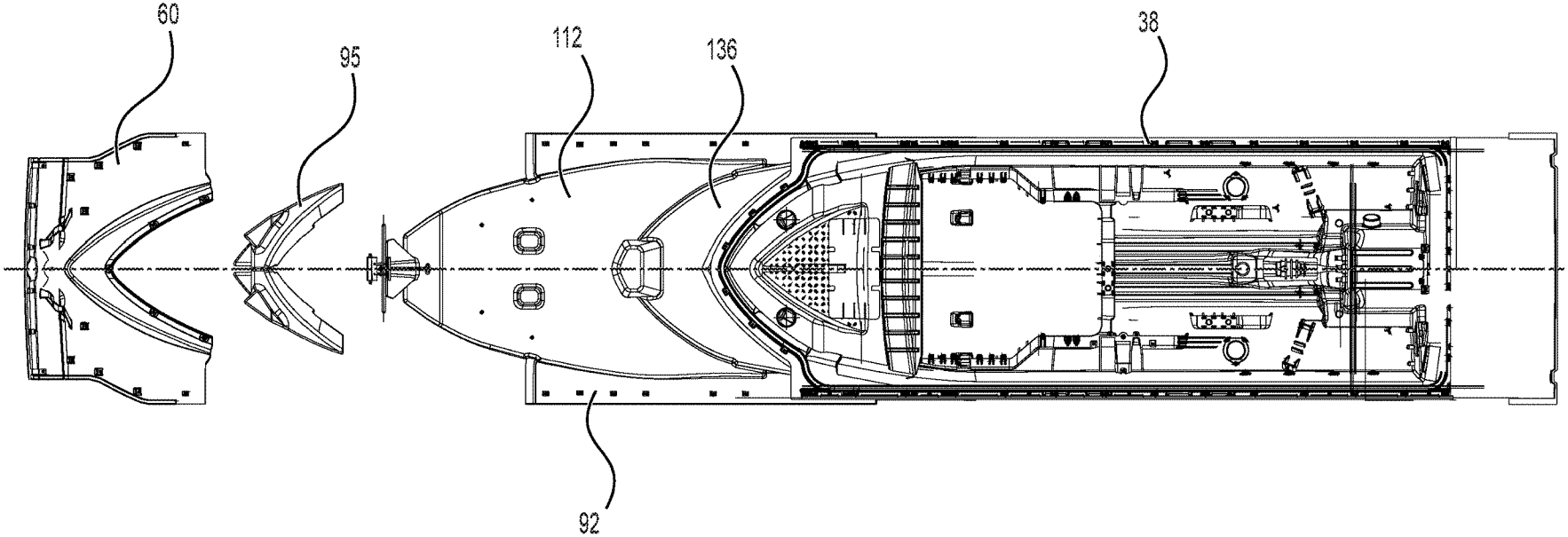
FIG. 27 is a top plan view of an exploded configuration of a central hull of the pontoon boat of FIG. 22.
Figure 28:
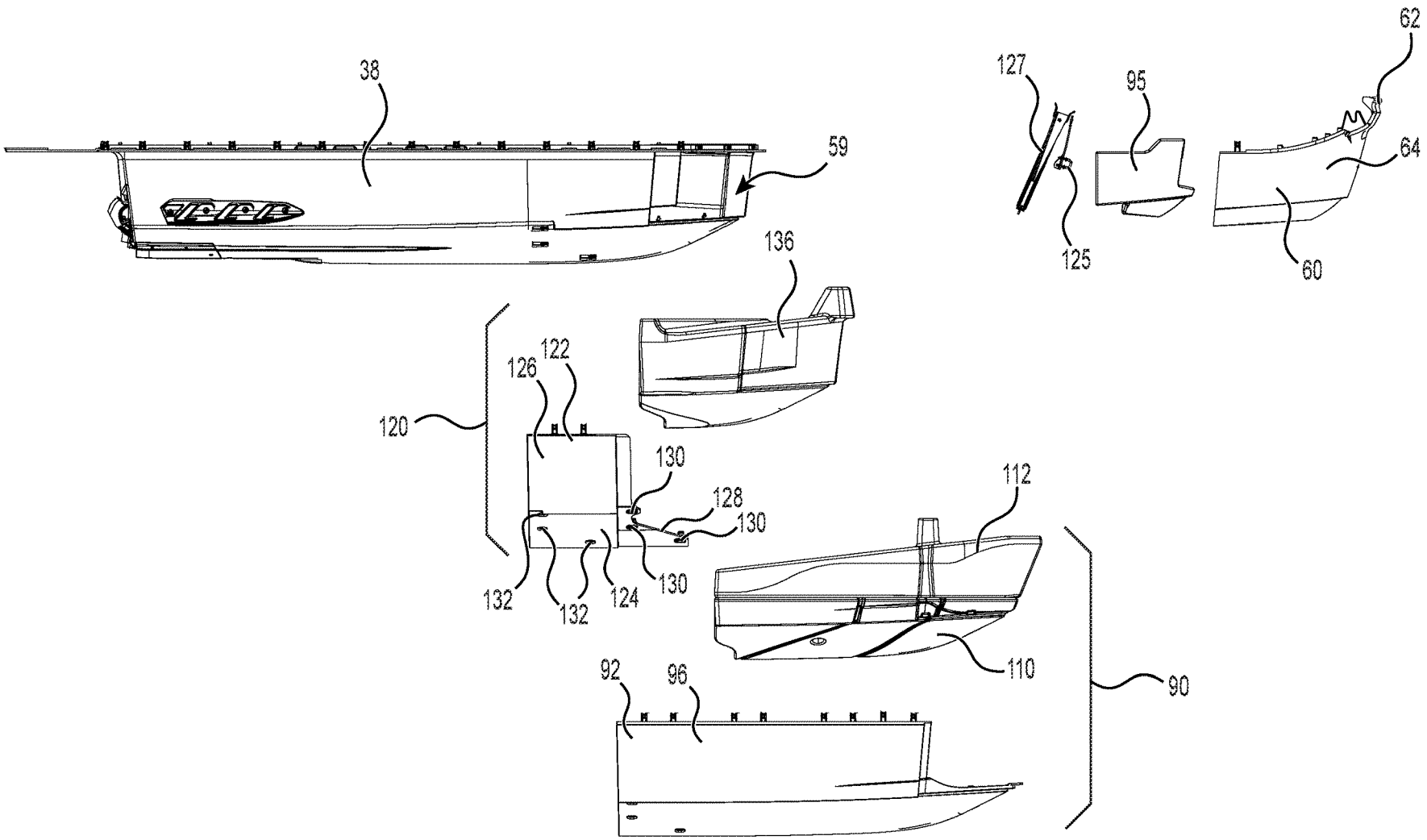
FIG. 28 is a right side elevation view of the exploded configuration of the central hull of FIG. 24.

With reference to FIGS. 25, 27 and 28, the additional hull extension module 120 is made buoyant by a buoyant element 136. As can be seen in FIG. 25, the buoyant element 136 is disposed between the buoyant elements 110, 112 and the front outer surface 83 of the rear hull panel 38. The buoyant element 136 is thus positioned rearwardly of the buoyant elements 110, 112 of the hull extension module 90. Moreover, the buoyant element 136 is positioned atop part of each of the hull extension panel 92 and the additional hull extension panel 122. A front surface 137 of the buoyant element 136 and the rear surfaces 114, 116 of the buoyant elements 110, 112 have corresponding shapes so that the buoyant element 136 and the buoyant elements 110, 112 are closely fitted with one another. In addition, a rear surface 138 of the buoyant element 136 and the front outer surface 83 of the rear hull panel 38 (defined by the front wall 52) have corresponding shapes so that the buoyant element 136 and the rear hull panel 38 are closely fitted with one another. As will be understood, this results in limited spacing between the buoyant element 136 and the buoyant elements 110, 112 as well as between the buoyant element 136 and the rear hull panel 38.

As will be understood from the above, the front outer surface 83 of the rear hull panel 38 matches the front surface 137 of the buoyant element 136 since both the front outer surface 83 and the front surface 137 fit against the rear surfaces 114, 116 of the buoyant elements 110, 112. Likewise, the rear surfaces 114, 116 of the buoyant elements 110, 112 match the rear surface 138 of the buoyant element 136 since the rear surfaces 114, 116 and the rear surface 138 fit against the front outer surface 83 of the rear hull panel 38.

The buoyant element 136 is constructed of a same or similar material as the buoyant element 80 of the rear hull module 32. The buoyant element 136 could also be made of alternative materials as described above with respect to the buoyant element 80. It is also contemplated that, in other embodiments, the additional hull extension panel 122 and the buoyant element could be formed by a single component, such as a hollow structure defining a hollow interior, that both forms the lower surface of the additional hull extension module 120 and provides buoyancy. Such an element could, for example, be a rotomolded component or a closed-cell foam with suitably strong outer skin.

Figure 24:
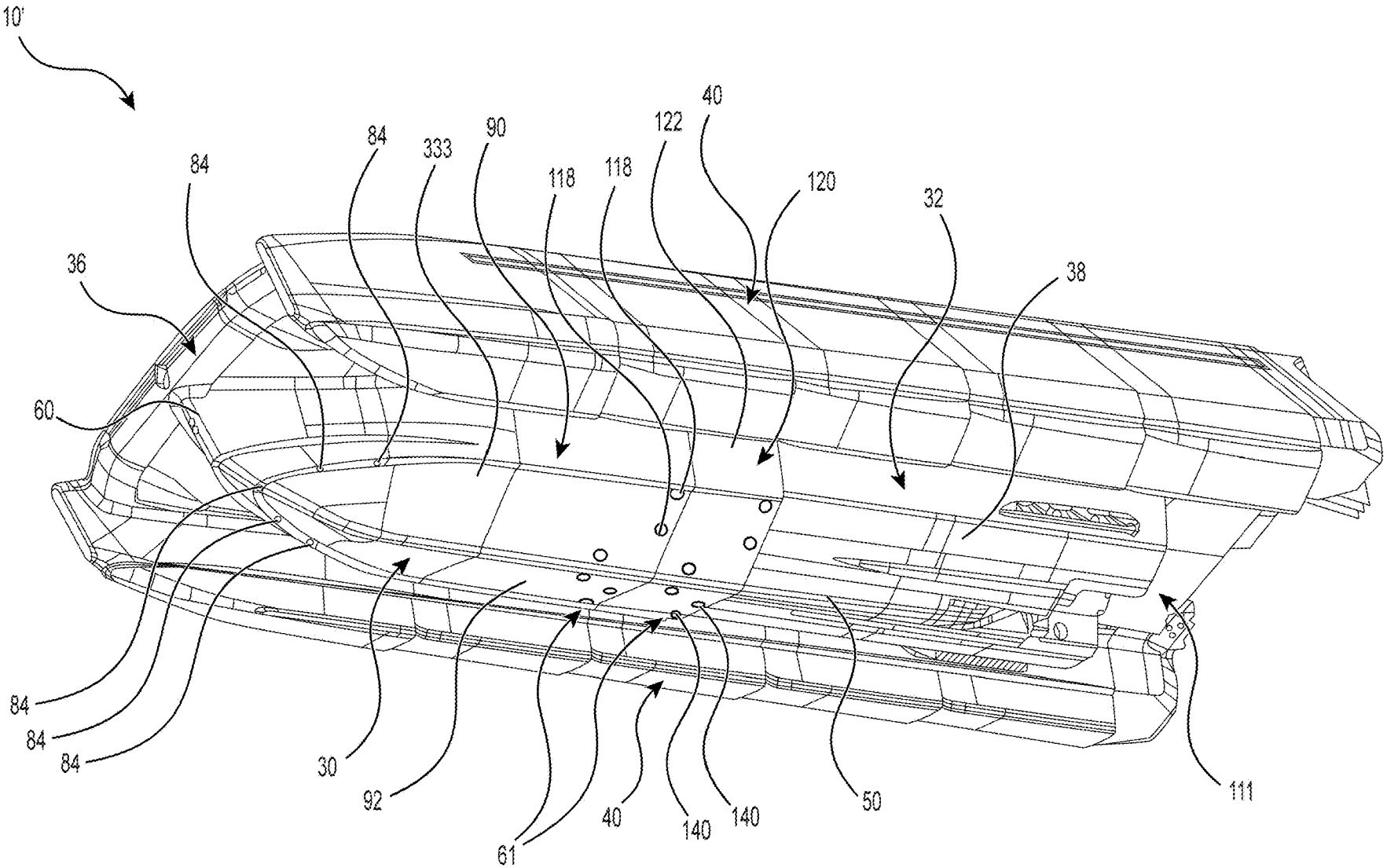
FIG. 24 is a perspective view, taken from a bottom left side, of the pontoon boat of FIG. 22.

In this embodiment, as shown in FIGS. 24 and 25, the boat 10" also includes a rear extension 111 for further extending the length of the boat 10". Notably, the rear extension 111 is a panel that is connected to the rear end 44 of the rear hull panel 38 to extend the length of the boat 10" rearwardly.

The method of assembly of the central hull 30 of the boat 10" thus involves the rear hull module 32, the front hull module 36, the hull extension module 90 and the additional hull extension module 120. Notably, when assembling the boat 10", the additional hull extension panel 122 is attached to the rear hull panel 38 such that the additional hull extension panel 122 extends forwardly of the rear hull panel 38; the hull extension panel 92 is attached to the additional hull extension panel 122 such that the hull extension panel 92 extends forwardly of the additional hull extension panel 122; and the front hull panel 60 is attached to the hull extension panel 92 such that the front hull panel 60 extends forwardly of the hull extension panel 92. In particular, the rear portion 133 of the additional hull extension panel 122 defining the openings 132 is positioned below the front portion 59 of the rear hull panel 38 that defines the openings 58, and the openings 132 of the additional hull extension panel 122 are aligned with the openings 58 of the rear hull panel 38. As shown in FIG. 24, fasteners 140 are then inserted into the openings 58, 132 to secure the additional hull extension panel 122 to the rear hull panel 38. In the present embodiment, the fasteners 140 comprise screws which threadedly engage the openings 58 of the rear hull panel 38, although other types of fasteners are contemplated, such as bolts and nuts or clips. For instance, in an alternate embodiment, one of the additional hull extension panel 122 and the rear hull panel 38 includes clips formed therein and arranged in the attachment pattern 61, while the other of the additional hull extension panel 122 and the rear hull panel 38 includes corresponding clip-receiving structures, such as an opening, similarly arranged in the attachment pattern 61 and sized and shaped to receive and retain the clips.

Next, the rear portion 104 of the hull extension panel 92 is positioned below the front portion 128 of the additional hull extension panel 122, and the openings 106 of the hull extension panel 92 are aligned with the openings 130 of the additional hull extension panel 122. The fasteners 118 are then inserted into the openings 106, 130 to secure the hull extension panel 92 to the additional hull extension panel 122. As mentioned above, the fasteners 118 could be other than screws. For instance, in some embodiments, the one of the additional hull extension panel 122 and the hull extension panel 92 includes clips formed therein and arranged in the attachment pattern 61, while the other of the additional hull extension panel 122 and the hull extension panel 92 includes corresponding clip-receiving structures, such as an opening, similarly arranged in the attachment pattern 61 and sized and shaped to receive and retain the clips.

Lastly, the rear portion 68 of the front hull panel 60 is positioned below the front portion 98 of the hull extension panel 92, and the openings 72 of the front hull panel 60 are aligned with the openings 102 of the hull extension panel 92. The fasteners 84 are then inserted into the openings 72, 102 to secure the front hull panel 60 to the hull extension panel 92.

As can be seen in FIGS. 27 and 28, the front hull module 36 of the boat 10" may also include a buoyant element 95 (e.g., a foam block) disposed between the front hull panel 60 and the rear hull panel 38. The boats 10, 10' could also include such a buoyant element 95.

Thus, in the context of the boat 10", the front hull panel 60, the rear hull panel 38, the hull extension panel 92 and the additional hull extension panel 122 together form the central hull 30 and define a substantially continuous running surface 333 of the boat 10". As shown in FIG. 25, a length L3 of the central hull 30 of the boat 10" is therefore defined between the front end 86 of the front hull panel 60 and the rear end 44 of the rear hull panel 38. The length L3 of the boat 10" is greater than the length L2 of the boat 10' (and by the same token, greater than the length L1 of the boat 10). In this embodiment, the additional hull extension panel 122 is not sealed to the rear hull panel 38 and the hull extension panel 92 below the water line of the boat 10" (i.e., the line where the hull 30 meets the surface of the water when the boat 10" is at rest on level water) and, as such, water can enter the space between the additional hull extension panel 122 and the hull extension panel 92, and/or between the additional hull extension panel 122 and the rear hull panel 38 via the joints therebetween, in particular when the boat 10" is at rest. However, because the space below the water line between the front hull panel 60, the hull extension panel 92, the additional hull extension panel 122, the rear hull panel 38 and the deck 20 is almost entirely filled with the buoyant elements 110, 112, 136 the non-sealed nature of those joints does not effect flotation of the central hull 30. It is contemplated that the additional hull extension panel 122 could be sealingly fixed to the rear hull panel 38 and the hull extension panel 92 below the water line.

Furthermore, as mentioned above, in this embodiment, the rear extension 111 further extends the length of the boat 10".

Given the greater length of the boat 10" compared to the boat 10', a longer deck is installed on the boat 10" than on the boat 10'. Notably, a deck 320 is installed on the central hull 30 such that it extends over the front hull module 36, the hull extension module 90, the additional hull extension module 120 and the rear hull module 32. The deck 320 includes the same components as the deck 220 but has additional tiles 22 to cover the added length of the boat 10". The additional hull extension module 120, and more particularly the buoyant element 136 of the present embodiment, provides buoyancy to support the additional deck area that extends thereabove.

Contrary to conventional watercraft hulls, the central hull 30 of the boats 10, 10', 10" is not entirely sealed such that portions of the interior thereof are in fluid communication with the exterior, more specifically the space between the front hull panel 60 and the rear hull panel 32. As such, while the running surfaces 33, 233, 333 are substantially continuous, water can flow into and out the space within the front hull module 36 and the space surrounding the buoyant elements 110, 112, 136 within the hull extension modules 90, 120 (if present) of the central hull 30, in particular when the boat 10, 10', 10" is at rest. Water cannot, under normal operating conditions, flow into and out of the rear hull panel 32. Notably, the buoyancy of the central hull 30 is provided by the buoyant elements thereof and therefore the flow of water into the central hull 30 is not problematic to the operation of the boat 10, 10', 10". This facilitates the manufacturing of the central hull 30 thus making it less expensive to produce, front hull panel 60, the hull extension panel 92, the additional hull extension panel 122 and the rear hull panel 38 can be made with significantly greater tolerances and the interfaces between these panels can forego being sealed. Furthermore, due to the manner in which the panels 38, 60, 92, 122 overlap one another, with the front portion of a rear one of two consecutive ones of the panels 38, 60, 92, 122 being disposed above a rear portion of the front one of the two consecutive ones of the panels 38, 60, 92, 122, water will not be forced into the central hull 30 when the boat 10, 10', 10" moves forward.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A method of assembling a watercraft of a family of watercraft, including at least a first watercraft and a second watercraft, the method comprising:

providing a rear hull module comprising a rear hull panel defining a power pack portion configured to receive at least in part a power pack of the watercraft;

providing a front hull module comprising a front hull panel defining at least in part a bow of the watercraft;

providing a hull extension module comprising a hull extension panel;

when assembling the first watercraft:

attaching the front hull panel to the rear hull panel such that the front hull panel extends forwardly of the rear hull panel;

the front hull panel and the rear hull panel forming a hull of the first watercraft and defining a substantially continuous running surface of the first watercraft, the first watercraft having a first hull length measured longitudinally between a front end of the front hull panel and a rear end of the rear hull panel;

when assembling the second watercraft:

attaching the hull extension panel to the rear hull panel such that the hull extension panel extends forwardly of the rear hull panel; and attaching the front hull panel to the hull extension panel such that the front hull panel extends forwardly of the hull extension panel, the front hull panel, the hull extension panel and the rear hull panel forming a hull of the second watercraft and defining a substantially continuous running surface of the second watercraft, the second watercraft having a second hull length measured longitudinally between the front end of the front hull panel and the rear end of the rear hull panel, the second hull length being greater than the first hull length.

2. The method of claim 1, wherein the hull extension module is a buoyant hull extension module.

3. The method of claim 2, wherein:

the hull extension module comprises at least one hull extension buoyant element; and the method further comprises, when assembling the second watercraft:

positioning the at least one hull extension buoyant element at least partly atop the hull extension panel.

4. The method of claim 3, wherein a rear surface of the at least one hull extension buoyant element and a front surface of the rear hull panel have corresponding shapes.

5. The method of claim 2, wherein, when assembling the second watercraft:

an interface between the hull extension panel and the front hull panel is sealed below a water line of the second watercraft; and an interface between the hull extension panel and the rear hull panel is sealed below the water line of the second watercraft.

6. The method of claim 1, wherein:

the front hull panel defines a plurality of attachment features arranged in a first attachment pattern;

the rear hull panel defines a plurality of attachment features arranged in the first attachment pattern;

the hull extension panel defines a plurality of attachment features arranged in the first attachment pattern;

attaching the front hull panel to the rear hull panel comprises:

aligning the plurality of attachment features of the front hull panel with the plurality of attachment features of the rear hull panel; and fastening the front hull panel to the rear hull panel via the pluralities of attachment features of the front hull panel and the rear hull panel; and attaching the front hull panel to the hull extension panel comprises:

aligning the plurality of attachment features of the front hull panel with the plurality of attachment features of the hull extension panel; and fastening the front hull panel to the hull extension panel via the pluralities of attachment features of the front hull panel and the hull extension panel.

7. The method of claim 6, wherein:

the plurality of attachment features of the rear hull panel is a plurality of first attachment features of the rear hull panel;

the plurality of attachment features of the hull extension panel is a plurality of first attachment features of the hull extension panel;

the rear hull panel defines a plurality of second attachment features arranged in a second attachment pattern;

the hull extension panel defines a plurality of second attachment features arranged in the second attachment pattern; and attaching the hull extension panel to the rear hull panel comprises:

aligning the plurality of second attachment features of the hull extension panel with the plurality of second attachment features of the rear hull panel; and fastening the hull extension panel to the rear hull panel via the pluralities of second attachment features of the hull extension panel and the rear hull panel.

8. The method of claim 1, further comprising:

when assembling the first watercraft:

installing a first deck that extends over the front hull module and the rear hull module;

and when assembling the second watercraft:

installing a second deck that extends over the front hull module, the rear hull module and the hull extension module.

9. The method of claim 1, wherein:

the family of watercraft includes a third watercraft;

the hull extension module is a first hull extension module and the hull extension panel is a first hull extension panel;

the method further comprises:

providing a second hull extension module comprising a second hull extension panel;

when assembling the third watercraft:

attaching the second hull extension panel to the rear hull panel such that the second hull extension panel extends forwardly of the rear hull panel;

attaching the first hull extension panel to the second hull extension panel such that the first hull extension panel extends forwardly of the second hull extension panel; and attaching the front hull panel to the first hull extension panel such that the front hull panel extends forwardly of the first hull extension panel, the front hull panel, the first hull extension panel, the second hull extension panel and the rear hull panel forming a hull of the third watercraft and defining a substantially continuous running surface of the third watercraft, the third watercraft having a third hull length measured longitudinally between the front end of the front hull panel and the rear end of the rear hull panel, the third hull length being greater than the second hull length.

10. The method of claim 1, wherein:

the hull of the first watercraft is a central hull of the first watercraft;

the hull of the second watercraft is a central hull of the second watercraft; and the method further comprises:

providing a first lateral hull and a second lateral hull;

when assembling any of the first watercraft and the second watercraft:

attaching the first lateral hull to the central hull on a first lateral side thereof; and attaching the second lateral hull to the central hull on a second lateral side thereof.

11. The method of claim 1, wherein attaching the front hull panel to the rear hull panel comprises:

positioning a rear portion of the front hull panel below a front portion of the rear hull panel.

12. The method of claim 1, wherein:

attaching the hull extension panel to the rear hull panel comprises positioning a rear portion of the hull extension panel below a front portion of the rear hull panel; and attaching the front hull panel to the hull extension panel comprises positioning a rear portion of the front hull panel below a front portion of the hull extension panel.

13. A system for assembling a watercraft of a family of watercraft, including at least a first watercraft and a second watercraft, the system comprising:

a rear hull module comprising a rear hull panel defining a power pack portion configured to receive at least in part a power pack of the watercraft;

a front hull module comprising a front hull panel defining at least in part a bow of the watercraft;

a hull extension module comprising a hull extension panel;

wherein, when the first watercraft is assembled:

the front hull panel is attached to the rear hull panel such that the front hull panel extends forward of the rear hull panel;

the front hull panel and the rear hull panel form a hull of the first watercraft and define a substantially continuous running surface of the first watercraft; and the first watercraft has a first hull length measured longitudinally between a front end of the front hull panel and a rear end of the rear hull panel;

wherein, when the second watercraft is assembled:

the hull extension panel is attached to the rear hull panel such that the hull extension panel extends forwardly of the rear hull panel;

the front hull panel is attached to the hull extension panel such that the front hull panel extends forwardly of the hull extension panel;

the front hull panel, the hull extension panel and the rear hull panel form a hull of the second watercraft and define a substantially continuous running surface of the second watercraft, the second watercraft has a second hull length measured longitudinally between the front end of the front hull panel and the rear end of the rear hull panel; and the second hull length is greater than the first hull length.

14. A watercraft, comprising:

a deck;

a hull supporting the deck, the hull comprising:

a rear hull panel defining a power pack portion;

a buoyant hull extension module attached to the rear hull panel such that the buoyant hull extension module extends forwardly of the rear hull panel;

a front hull panel defining at least in part a bow of the watercraft, the front hull panel being attached to the buoyant hull extension module such that the front hull panel extends forwardly of the buoyant hull extension module;

and a power pack at least partly disposed in the power pack portion of the rear hull panel.

15. The watercraft of claim 14, wherein:

the buoyant hull extension module comprises a hull extension panel;

the hull extension panel is attached to the rear hull panel such that the hull extension panel extends forwardly of the rear hull panel; and the front hull panel is attached to the hull extension panel such that the front hull panel extends forwardly of the hull extension panel.

16. The watercraft of claim 15, wherein the buoyant hull extension module further comprises:

at least one hull extension buoyant element positioned at least partly atop the hull extension panel.

17. The watercraft of claim 16, wherein a rear surface of the at least one hull extension buoyant element and a front surface of the rear hull panel have corresponding shapes.

18. The watercraft of claim 14, wherein:

the hull is a central hull;

the watercraft further comprises:

a first lateral hull; and a second lateral hull, each of the first and second lateral hulls supporting part of the deck;

and the central hull is disposed laterally between the first lateral hull and the second lateral hull.

19. The watercraft of claim 14, further comprising a rear bumper connected to and extending rearwardly from the rear hull panel.

* * * * *